US005997396A

United States Patent [19]

Itako

[11] Patent Number: 5,997,396

[45] Date of Patent: Dec. 7, 1999

[54] SYSTEM AND METHOD FOR MANAGING QUANTITY OF STORED COINS

[75] Inventor: Eiji Itako, Sakado, Japan

[73] Assignee: Nippon Conlux Co., Ltd., Tokyo, Japan

[21] Appl. No.: 08/898,673

[22] Filed: Jul. 22, 1997

[30] Foreign Application Priority Data

Jul. 22, 1996 [JP] Japan ..... 8-210573

[51] Int. Cl.[6] ..... G07D 1/00

[52] U.S. Cl. ..... 453/17; 453/20

[58] Field of Search ..... 453/17, 20; 194/216, 194/217, 218

[56] References Cited

U.S. PATENT DOCUMENTS 4,883,158 11/1989 Kobayashi et al. ..... 453/17
5,499,944 3/1996 Weston et al. ..... 453/17

FOREIGN PATENT DOCUMENTS 6-82426 10/1994 Japan .

*Primary Examiner*—F. J. Bartuska
*Attorney, Agent, or Firm*—Graham & James LLP

[57] ABSTRACT

A coin handling mechanism includes a counter for counting coins incoming and outgoing to and from a cassette-type coin storage tube. In response to detection of temporary detachment of the cassette during collection of the stored coins from the tube, the counted value of the counter is initially set to a predetermined value. Then, in response to activation of a predetermined switch during next collection of the stored coins from the tube, a determination is made as to whether the current value of the counter is greater than the initially-set predetermined value. If so, a specific number of the coins corresponding to a difference between the current value and the initially-set predetermined value are automatically paid out from the tube, but if not, the cassette is temporarily detached for manual supply of a necessary number of additional coins to the tube without the stored coins being paid out from the tube. This way, the management to prestore a predetermined quantity of coins in the coin storage tube can be performed in a simplified manner during collection of the stored coins and supply of additional coins from and to the coin storage tube.

19 Claims, 12 Drawing Sheets

SYSTEM AND METHOD FOR MANAGING QUANTITY OF STORED COINS

BACKGROUND OF THE INVENTION

The present invention relates generally to coin handling mechanisms for use in automatic vending machines, money changing machines and the like, and more particularly to a system and method for properly managing the quantity of stored coins in a coin storage device of a coin handling mechanism.

In general, coin handling mechanisms presently used in automatic vending machines and coin changing machines include a coin storage device commonly known as a coin tube unit. Coins deposited through a coin inlet or slot of the machine are routed to the coin tube unit for storage therein so that the stored coins in the unit are paid out (i.e., issued or discharged) as change or the like. Once the quantity of the stored coins (coin reserves) in the coin tube unit reaches a full-capacity level in any of the coin tubes, some coins overflowing from the coin tube unit are deflected to a cash box.

Conventionally, for management of the quantity of stored coins (coin reserves) in the coin tube unit, a machine managing person (e.g., route man) operates a predetermined inventorying switch to discharge all the stored coins from the coin tube unit, temporarily collects the discharged coins as proceeds, and then manually supplies or replenishes the coin tube unit with an appropriate quantity of coins for use as change to be returned to purchasers. In this case, it is extremely important to know how many coins have been manually supplied, because the total quantity of the manually-supplied coins is the initial or starting point to reckon next-collected proceeds. To this end, it has been conventional for the machine managing person to manually resupply coins while counting the number of the coins supplied (first conventional approach), or to continue manually supplying coins until the coin tube unit is filled with these coins to its recognized full-capacity level to thereby determine the quantity of the supplied coins from the full-capacity level in the unit (second conventional approach).

However, the first conventional approach has the problem that manually supplying coins while counting the number of the coins supplied is very cumbersome and apt to cause errors. On the other hand, the second conventional approach only provides a very inconvenient management in that the full-capacity level does not necessarily represent a same number of coins, for each of the coin tubes, due to different sizes of the coin tubes or different thicknesses of the coins of various denominations to be stored respectively in the individual coin tubes.

To provide a solution to the above-discussed problems, Japanese Patent Publication No. HEI-6-82426 discloses an automatic vending machine, where a to-be-initially-stored quantity is optionally set in numerical value for each denomination of the coins, and payout (issue) or supply of the stored coins is performed for each denomination in such a manner that coins corresponding to the to-be-initially-stored quantity may be stored in the coin storage device at the time of inventory. Further, according to the disclosure of the Japanese HEI-6-82426 publication, arithmetic operations to calculate an increase/decrease in the quantity of the coins corresponding to each supplied or paid-out (issued) coin is performed, during the normal operation of the coin handling mechanism, with respect to the to-be-initially-stored quantity value, so as to constantly provide for accurate calculation and management of the quantity of stored coins in the coin storage device.

However, with the prior art mechanism disclosed in Japanese Patent Publication No. HEI-6-82426, a particular means has to be provided to numerically set the to-be-initially-stored quantity for each denomination and it would involve very cumbersome setting operations. Further, because such a numerically setting means is generally provided in a central control section of the automatic vending machine considerably apart from the coin handling mechanism, it is not easy for an unexperienced machine managing person (such as an unexperienced route man) to operate both the coin handling mechanism and the central control section.

SUMMARY OF THE INVENTION

It is therefore an object of the present invention to provide a system and method which greatly facilitate management for initially storing a predetermined quantity of coins in a coin storage device, and a recording medium containing program codes to implement such a method.

In order to accomplish the above-mentioned object, the present invention according to a first aspect provides a stored-coin-quantity managing system for use with a coin handling mechanism that includes a detachable coin storage device, a mechanism for routing a deposited coin to the coin storage device for reception therein, a mechanism for paying out a stored coin from the coin storage device, and a detector for detecting that the coin storage device has been detached from the coin handling mechanism. This stored-coin-quantity managing system comprises: a counter which counts an increase and decrease in a quantity of the stored coins in the coin storage device; a count controller which performs control to reset a count of the counter to a predetermined value in response to the detector detecting that the coin storage device has been temporarily detached from the coin handling mechanism and to increment or decrement the count of the counter in response to subsequent reception or payout or issue of a coin into or from the coin storage device; a switch which is activated by a coin managing person; and a coin payout controller which, in response to activation of the switch by the coin managing person, determines a difference between a current counted value of the counter and the predetermined value and performs control to pay out or issue from the coin storage device a specific number of the stored coins corresponding to the difference if a quantity of received coins is greater than a quantity of paid-out coins.

When the managing person temporarily detaches the coin storage device from the body frame of the coin handling mechanism and then re-attaches the coin storage device to the body frame, the detachment of the storage device is detected by the detector, in response to which the count of the counter is reset to a predetermined value. The predetermined value to which the counter is reset may be any optional value such as "0"—therefore, the term "reset" used herein should be considered to be interchangeable with the term "preset". It does not matter how many coins are actually stored as a to-be-initially stored-quantity or initial reserve level (here, provisionally represented by "x"). Of course, a shortage of the stored coins leading to a shortage of change would present a significant problem; however, a necessary quantity of stored coins can be provided by manually supplying an appropriate number of additional coins to the coin storage device when the storage device is detached from the body frame of the coin handling mechanism. Thus, when the coin storage device is detached from the body frame of the coin handling mechanism for inventorying collection of the stored coins by the managing person, the coin storage device can be manually resupplied or replenished with any necessary number of coins and then re-attached to the body frame, so that the coin handling mechanism is restored to the usable condition and at the same time the counter is reset to the predetermined value (e.g., "0"). Here, because it is not always necessary for the predetermined value (e.g., "0"), initially set in the counter, to exactly indicate the actual quantity of initially stored coins or initial reserves (x), no particular operation is required to set the predetermined value and the actual quantity of initially stored coins (x) to exactly agree with each other.

Then, as a coin is deposited and supplied to the coin storage device during the normal operation of the coin handling mechanism, the count of the counter is incremented by one (i.e., one is added to the current counted value); alternatively, the count may be decremented by one in this case. Conversely, as a coin is paid out or issued, as change or the like, from the coin storage device during the normal operation of the coin handling mechanism, the count of the counter is decremented by one (i.e., one is subtracted from the current counted value); alternatively, the count may be incremented by one in this case. In this manner, the quantity of incoming (received) and outgoing (paid-out) coins is counted (added and subtracted) with the initially-reset predetermined value (e.g., "0") as a starting value.

Once the managing person activates the switch during inventorying collection of the stored coins, the coin payout controller, in response to the activation of the switch, determines a difference between the current counted value of the counter and the predetermined value and then performs control to pay out or issue from the coin storage device a specific number of the stored coins corresponding to the thus-determined difference if the quantity of received coins is greater than the quantity of paid-out or issued coins (e.g., the current counted value>the predetermined value). This way, the quantity of coins left stored in the coin storage device can be adjusted to agree with the quantity of initially stored coins (x), so that the inventorying collection can be automatically executed in such a manner that the predetermined quantity (x) of coins are constantly present in the coin storage device. If, on the other hand, the quantity of received coins is not greater than the quantity of paid-out or issued coins (e.g., the current counted value≦the predetermined value), no coin is not issued from the coin storage device; in this case, it is only necessary that at the end of the inventorying collection, the managing person temporarily detach the coin storage device from the body frame of the coin handling mechanism to visually inspect the current coin reserves in the coin storage device and manually supply an appropriate number of additional coins to the storage device if necessary. Thus, the counter is again reset or initialized to the predetermined value (e.g., "0"), so that initial conditions for counting subsequent incoming and outgoing coins can be set accurately with ease.

As described above, the present invention is characterized in that when it is detected that the coin storage device has been temporarily detached from the body frame of the coin handling mechanism, the count of the counter is automatically reset (initialized) to the predetermined value for use in subsequent calculation of the number of received (incoming) and paid-out (outgoing) coins. Thus, at the time of the collection of the stored coins from the coin storage device or the supply of additional coins to the coin storage device, this characteristic arrangement greatly facilitates the management for constantly allowing a predetermined quantity of coins to be initially stored in the coin storage device in a presumptive manner, without the need to numerically set the to-be-initially-stored quantity or initial reserve level as in prior art. As a result, the machine managing person is allowed to perform necessary the inventorying collection of the stored coins through very simple manual operations only on the coin handling mechanism.

The following arrangement may be applied to further facilitate the necessary operations at the time of a shortage of stored coins or coin reserves in the coin storage device. Namely, the coin storage device may include a coin tube having a transparent wall portion to permit a visual inspection of the interior of the coin tube, and a visual mark may be put on the coin tube at a given location thereof corresponding to the level of a predetermined quantity of coins to be stored in the coin tube. Thus, when the coin tube runs short of the stored coins, this arrangement allows additional coins to be manually supplied to the coin tube up to the predetermined quantity using the visual mark as a manual coin-supplying standard. As a consequence, presence/absence of a shortage in the coin reserves can be visually ascertained with ease at the end of the inventorying coin collection, and the manual supply of additional coin up to the to-be-initially-stored quantity (initial coin reserve level) can be done very easily using the visual mark.

Further, the stored-coin-quantity managing system of the present invention may further comprise a flag which operates on the basis of an output from the detector in such a manner that the flag is reset in response to the detachment of the coin storage device from the coin handling mechanism but set in response to the attachment of the coin storage device to the coin mechanism; and an initializing section which resets the flag upon turning-on of a power source. The coin payout controller performs the control to pay out a specific number of the stored coins corresponding to the determined difference, on condition that the flag is set. Namely, in the event of a power failure between the last and current inventorying collections, the counter would yield inaccurate counted values, so that it is not desirable to perform the coin payout control on the basis of the inaccurate counted values. But, with the arrangement of the present invention, such an inconvenience can be avoided by resetting the flag in response to the power failure to thereby inhibit execution of the coin payout control. However, such a flag management is not necessary in the case where the counter is backed up by an electric cell or implemented by a non-volatile memory.

A second aspect of the present invention provides an improved stored-coin-quantity managing system for a coin handling mechanism that includes a detachable coin storage device, a mechanism for routing a deposited coin to the coin storage device for reception therein, a mechanism for paying out a stored coin from the coin storage device, a first detector for detecting that the coin storage device has been detached from the coin handling mechanism, a second detector for detecting that a quantity of the stored coins in the coin storage device has increased to a predetermined full-capacity level, and a third detector for detecting that the quantity of the stored coins in the coin storage device has decreased to a predetermined empty level. This improved stored-coin-quantity managing system comprises: a counter which counts an increase and decrease in the quantity of the stored coins in the coin storage device; a first preset controller which presets a count of the counter to a predetermined first value in response to the first detector detecting that the coin storage device has been re-attached to the coin handling mechanism after being temporarily detached therefrom; a second preset controller which presets the count of the counter to a predetermined second value corresponding to the full-capacity level in response to the second detector detecting that the quantity of the stored coins in the coin storage device has increased to the full-capacity level and which presets the count of the counter to a predetermined third value corresponding to the empty level in response to the third detector detecting that the quantity of the stored coins in the coin storage device has decreased to the empty level; a count controller which performs control to increment or decrement the count of the counter in response to reception or payout of a coin into or from the coin storage device; a switch which is activated by a coin managing person; and a coin payout controller which, in response to activation of the switch by the coin managing person, determines a difference between a current counted value of the counter and the first predetermined first value and performs control to pay out from the coin storage device a specific number of the stored coins corresponding to the difference if a quantity of received coins is greater than a quantity of paid-out coins.

The present invention according to a second aspect arranged in this manner is similar to the above-discussed first aspect in that the count of the counter is automatically reset (initialized ) to the first predetermined value in response to detachment of the coin storage device from the body frame of the coin handling mechanism, and accomplishes similar operation and advantageous results to those attained by the first aspect. Similarly to the above-mentioned, the first predetermined value to which the counter is reset (initially set) does not necessarily represents an accurate quantity of currently stored coins in the coin storage device.

The second aspect of the present invention is different from the first aspect in that the counter is preset to the second predetermined value corresponding to the full-capacity level in response to detection of coins stored in the coin storage device to its full capacity, and is also preset to the third predetermined value corresponding to the empty or change-shortage level in response to detection of the empty or change-shortage condition in the coin storage device. Thus, once the stored coins have reached the full-capacity level or empty or change-shortage level during the normal operation of the coin handling mechanism, the counter is preset to the second or third predetermined value so that the count of the counter is automatically modified to a value representative of an accurate quantity of currently stored coins. This arrangement would greatly enhance the accuracy in managing the quantity of the stored coins.

As with the first aspect invention, the coin storage device in the second aspect invention may include a coin tube having a transparent wall portion to permit a visual inspection of the interior of the coin tube, and a visual mark may be put on the coin tube at a given location thereof corresponding to the level of a predetermined quantity of coins to be stored in the coin tube. Thus, when the coin tube runs short of the stored coins, this arrangement allows additional coins to be manually supplied to the coin tube up to the predetermined quantity using the visual mark as a manual coin-supplying standard.

Further, the stored-coin-quantity managing system according to the second aspect may further comprise a flag which operates on the basis of an output from the detector in such a manner that the flag is reset in response to the detachment of the coin storage device from the coin handling mechanism but set in response to the attachment of the coin storage device to the coin mechanism; and an initializing section which resets the flag upon turning-on of a power source. The coin payout controller may perform the control to pay out a specific number of the stored coins corresponding to the determined difference, on condition that the flag is set.

Also, the stored-coin-quantity managing system may further comprise a second coin payout controller which, if the flag is in a reset state at the time of activation of the switch and the third detector has not detected the empty condition, performs control to automatically pay out the stored coins from the coin storage device until the third detector detects the empty condition. Namely, although the counter would yield inaccurate counts in the event of a power failure, it is likely that a sufficient quantity of coins are present in the coin storage device if the third detector has not detected the empty condition; these coins should of course be discharged and collected from the storage device at the time of the inventorying collection. Thus, it is preferred that control be performed to allow the stored coins to be automatically paid out or discharged from the coin storage device until the third detector detects the empty condition. Of course, as with the first aspect invention, it is only necessary here that at the end of the inventorying coin collection, the managing person temporarily detach the coin storage device from the body frame of the coin handling mechanism to visually inspect the current coin reserves in the coin storage device and manually supply an appropriate number of additional coins to the storage device as required, and that the counter is again reset or initialized to the first predetermined value. However, such a flag management and second payout controller are not necessary in the case where the counter is backed up by an electric cell or implemented by a non-volatile memory.

As conventionally known in the art, the above-mentioned coin storage device may include a plurality of coin storage tube, in which case the above-mentioned individual control is of course performed separately for each of the tubes.

As a modification of the stored-coin-quantity managing system according to the first and second aspect of the present invention, the detector for detecting the detachment of the coin storage device may be omitted by employing the arrangement that the count of the counter is automatically reset after the difference between the current counted value of the counter and the predetermined value is determined in response to activation of the switch by the managing person.

To this end, a modification of the stored-coin-quantity managing system according to the first aspect of the present invention comprises: a counter which counts an increase and decrease in a quantity of the stored coins in the coin storage device; a count controller which performs control to increment or decrement a count of the counter in response to reception or payout of a coin into or from the coin storage device; a switch which is activated by a coin managing person; a coin payout controller which, in response to activation of the switch by the coin managing person, determines a difference between a current counted value of the counter and a predetermined reset value and performs control to pay out from the coin storage device a specific number of the stored coins corresponding to the difference if a quantity of received coins is greater than a quantity of paid-out coins; and a reset controller which, after the difference is determined by the coin payout controller in response to activation of the switch, resets the count of the counter to the predetermined reset value.

Further, a modification of the stored-coin-quantity managing system according to the second aspect of the present invention comprises: a counter which counts an increase and decrease in the quantity of the stored coins in the coin storage device; a count controller which performs control to increment or decrement the count of the counter in response to reception or payout of a coin into or from the coin storage device; a switch which is activated by a coin managing person; a coin payout controller which, in response to activation of the switch by the coin managing person, determines a difference between a current counted value of the counter and a predetermined first value and performs control to pay out from the coin storage device a specific number of the stored coins corresponding to the difference if a quantity of received coins is greater than a quantity of paid-out coins; a first preset controller which, after the difference is determined by the coin payout controller in response to activation of the switch, presets the count of the counter to the predetermined first value; and a second preset controller which presets the count of the counter to a predetermined second value corresponding to the full-capacity level in response to the second detector detecting that the quantity of the stored coins in the coin storage device has increased to the full-capacity level and which presets the count of the counter to a predetermined third value corresponding to the empty level in response to the third detector detecting that the quantity of the stored coins in the coin storage device has decreased to the empty level.

BRIEF DESCRIPTION OF THE DRAWINGS

For better understanding of the above and other features of the present invention, the preferred embodiments of the invention will be described in greater detail below with reference to the accompanying drawings, in which.

DETAILED DESCRIPTION OF THE PREFERRED EMBODIMENTS

Figure 1:
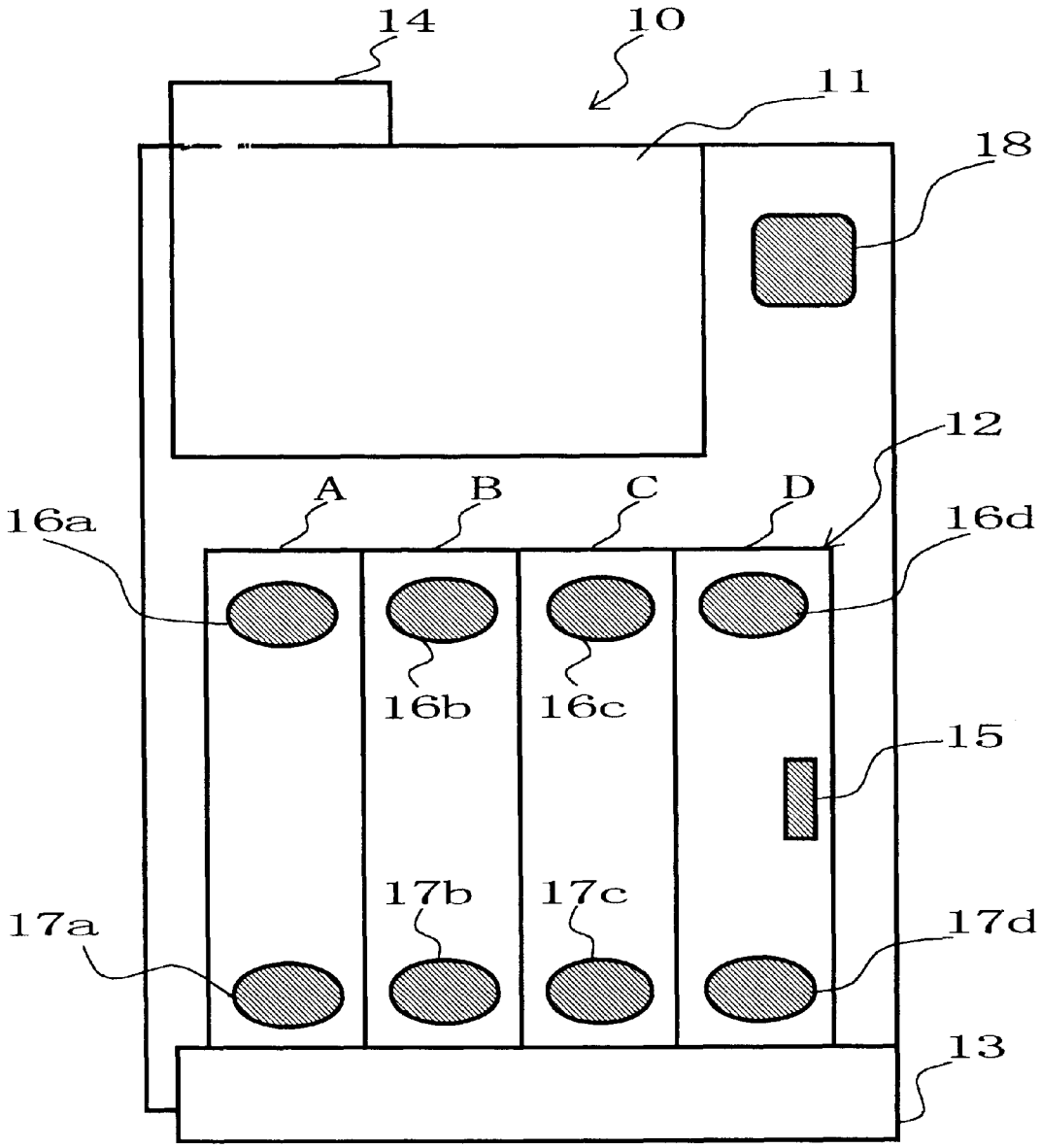
FIG. 1 is a schematic overall view of a coin handling mechanism in accordance with the present invention.
Figure 2:
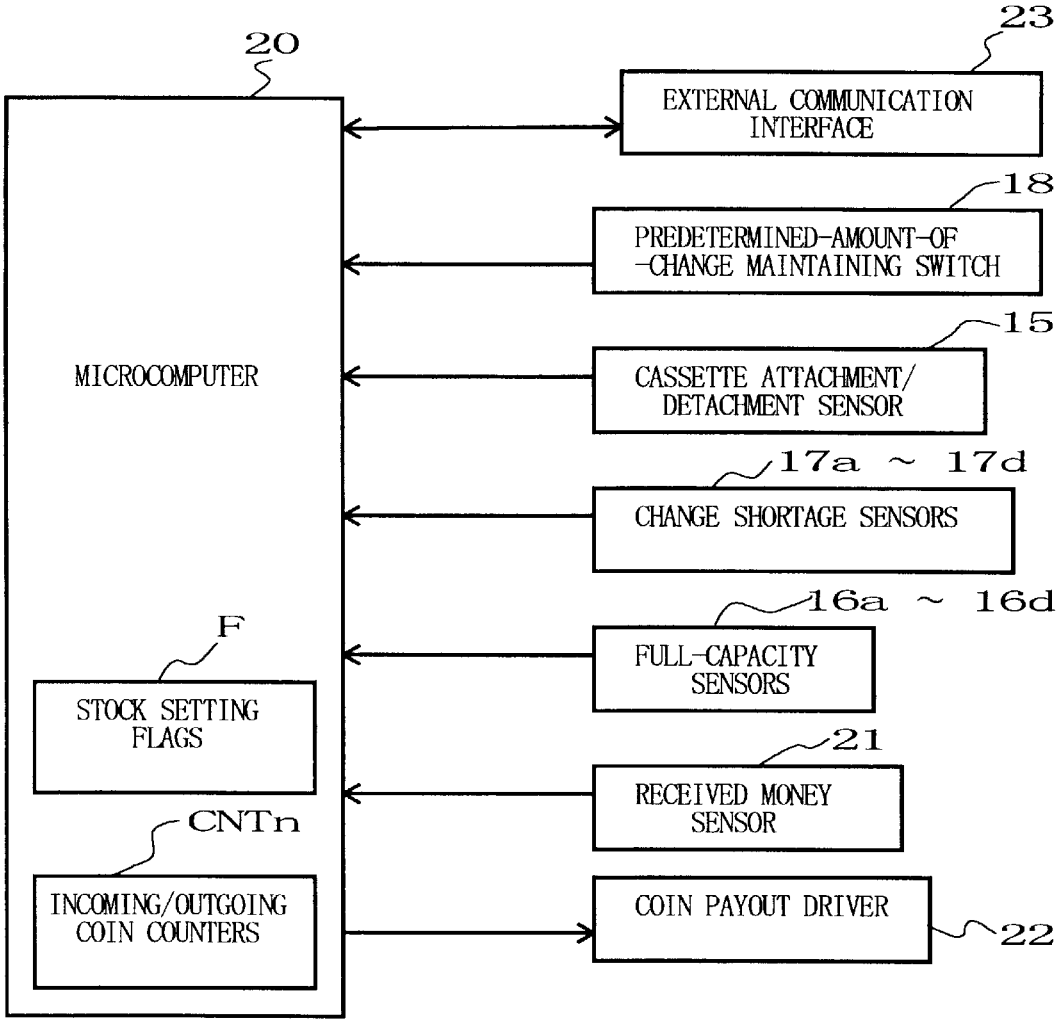
FIG. 2 is a block diagram illustrating an overall hardware structure of control circuitry in accordance with an embodiment of the present invention built in the coin handling mechanism of FIG. 1.

FIG. 1 is a schematic view of a coin handling mechanism in accordance with an embodiment of the present invention, and FIG. 2 is a block diagram illustrating an overall hardware structure of control circuitry provided within the coin handling mechanism 10 of FIG. 1. The coin handling mechanism 10 generally comprises a coin sorter 11, a coin storage device or coin tube unit 12, a coin payout or issue mechanism 13, and the control circuitry shown in FIG. 2. The coin sorter 11 determines genuineness of each coin deposited and introduced through an coin inlet 14 to mechanically sort the deposited coins into "genuine coins" and "counterfeit coins".

The coin sorter 11 directs the counterfeit coins to a coin returning passage (not shown) and further sorts the genuine coins according to their denominations.

The coin storage device or coin tube unit 12, which is detachably attached to a body frame of the coin handling mechanism 10, includes a plurality of coin tubes A, B, C and D provided for the individual denominations. Each of the deposited coins sorted by the coin sorter 11 as a genuine coin is routed to one of the coin tubes A, B, C and D of the corresponding denomination for reception and storage therein. The coin payout mechanism 13 pays out or issues one or more coins from any of the coin tubes A, B, C and D as change or the like to be returned to a purchaser. As well known in the art, the coin sorter 11 includes an opto-electronic or mechanical deposited coin sensor (not shown), which generates a denomination-specific coin detection signal in response to each coin identified as genuine and routed to the coin storage device 12.

On a predetermined position of the coin mechanism 10, there is mounted a cassette attachment/detachment sensor 15 for detecting that the cassette-type coin storage device 12 has been detached from or attached to the body frame of the coin handling mechanism.

Further, each of the coin tubes of the coin storage device 12 contains a full-capacity sensor 16*a*, 16*b*, 16*c*, 16*d* and a change shortage sensor 17*a*, 17*b*, 17*c* 17*d*. The full-capacity sensor 16*a*, 16*b*, 16*c*, 16*d* each detects that the quantity of coins stored in the corresponding tube A, B, C, D has increased to a predetermined full-capacity level, while the change shortage sensor 17*a*, 17*b*, 17*c* 17*d* each detects that the quantity of coins stored in the corresponding tube A, B, C, D has decreased to a predetermined empty (change shortage) level. Note that the predetermined empty (change shortage) level is not necessarily an exact "out of change" level, but another appropriate low level corresponding to a predetermined small quantity of stored coins that may be used as a threshold or reference level to warn of shortage of stored coins to be used as change to be returned to purchasers.

Any coin or coins overflowing from any of the coin tubes of the storage device 12 beyond the full-capacity level are deflected to a cash box (not shown), but this feature is not part of the present invention and hence will not be described in detail here for simplicity. The above-described arrangements of the coin handling mechanism 10 are well known in the art and hence may be replaced with other equivalent or similar arrangements as desired.

In the coin handling mechanism 10 of the present invention, a predetermined-amount-of-change maintaining switch 18 is provided at an appropriate place on the body frame of the coin handling mechanism. This predetermined-amount-of- change maintaining switch 18 is typically activated by a machine managing person or route man during inventorying collection of stored coins. In response to the activation of the switch 18 by the managing person, a "predetermined-amount-of-change maintaining" process is performed to permit only a predetermined quantity of coins to be left in the coin storage device 12 as "initial reserves" for use as change to be returned to purchasers, by automatically discharging or paying out excess or superfluous the stored coins from the storage device 12, as will be later described in greater detail.

To allow visually ascertaining the quantity of currently stored coins in the individual coin tubes A to D of the storage device 12, at least a portion of each of the tubes may be formed of a transparent wall for a visual inspection of the interior of the coin tube. Further, a visual mark may be put on each of the coin tubes A to D at a particular location thereof corresponding to the level of a predetermined quantity of coins to be stored one on another in the coin tube, so as to allow the managing person to visually ascertain whether the currently stored coins are in proper quantity or not using the mark as a yardstick or standard.

Referring now to FIG. 2, a microcomputer 20 is provided to control various operations of the coin handling mechanism 10, to which are supplied external signals from the above-mentioned sensors 15, 16*a* to 16*d* and 17*a* to 17*d*, predetermined-amount-of-change maintaining switch 18, received money sensor 21. In response to these external signals, the microcomputer 20 executes various processes based on control flows as shown in FIGS. 3 to 6. When, during the course of these processes, there occurs a need to operate the coin payout mechanism 13 to pay out or discharge one or more coins from any of the coin tubes A to D, the microcomputer 20 issues a coin payout instruction to a coin payout driver 22, which may be in the form of a motor or solenoid provided in the coin payout mechanism 13. Also, the microcomputer 20 exchanges information with another control device (such as a central control device in the body of the automatic vending machine) via an external communication interface 23. For example, the external communication interface 23 is used by the microcomputer 20 to transmit deposited-money-amount information to the control control device of the vending machine and to receive a change payout instruction from the control control device. However, in the present invention, the inventorying collection of stored coins does not require the information exchange with the central control device in the body of the vending machine, and thus every necessary operation is performed in the coin handling mechanism 10 alone 10.

The microcomputer 20 contains an incoming/outgoing coin counter CNTn for, every coin tube A to D, indicating each coin storage (reception) or payout into or from the coin tube, and a stock setting flag F. As will be explained later, the incoming/outgoing coin counter CNTn for each of the coin tubes is reset to an initial value (e.g., 0) when the cassette attachment/detachment sensor 15 detects that the cassette-type coin storage device 12 has been temporarily detached from the body frame of the coin handling mechanism, and its count is incremented or decremented in response to storage (reception) or payout of a coin into or from the coin tube. On the basis of the output signal from the cassette attachment/detachment sensor 15, the stock setting flag F is reset to a value "0" in response to detachment of the cassette-type coin storage device 12 from the body frame of the coin handling mechanism 10 and set to a value "1" in response to attachment of the coin storage device 12 to the body frame. When the flag F indicates that the coin storage device 12 has been detached and again attached (re-attached) soon afterwards, the coin handling mechanism 10 assumes that an operations has been performed to initially set the quantity of coins to be stored in the storage device 12. Also, the stock setting flag F is reset to "0" upon power-on or turning-on of a power supply, and if the flag F is at the reset value "0" during the inventorying collection of stored coins, it indicates that there has been a power failure.

Now, with reference to FIGS. 3 to 6, a description will be made hereinbelow about a specific example of control in a preferred embodiment according to a first aspect of the present invention.

Figure 3:
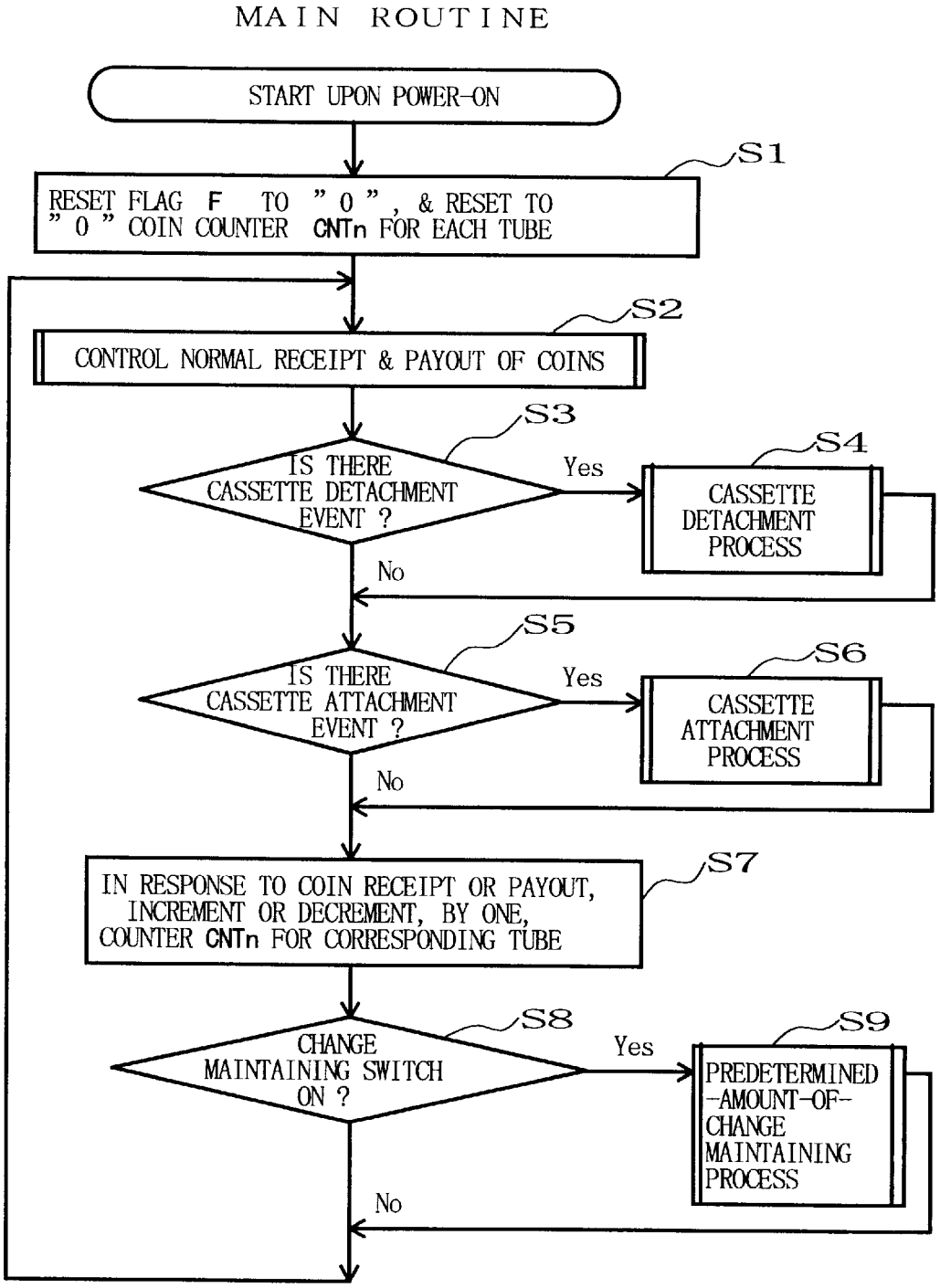
FIG. 3 is a flowchart of a main routine executed by a microcomputer of FIG. 2 in response to power-on of the coin handling mechanism.
Figure 4:
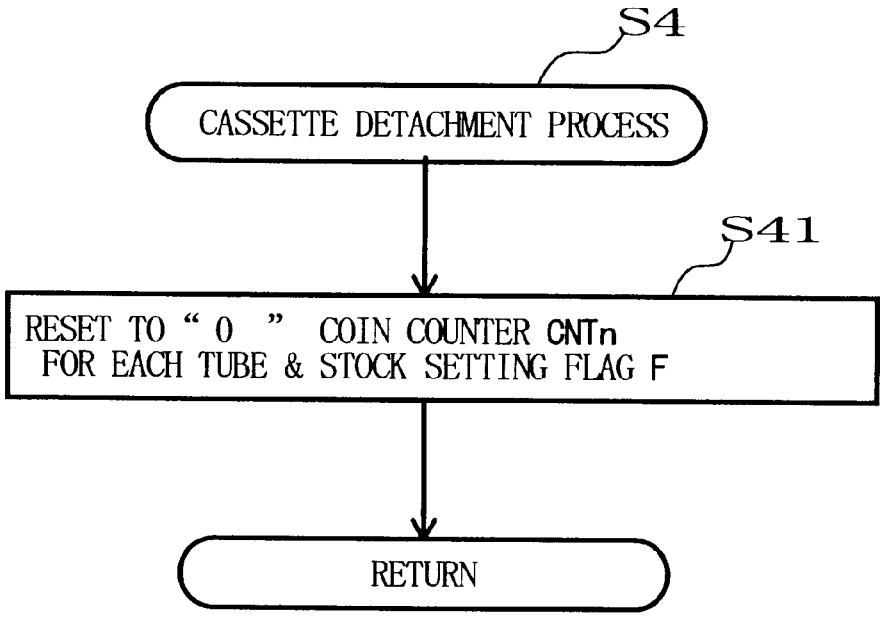
FIG. 4 is a flowchart illustrating a detailed example of a cassette detachment process of FIG. 3.

FIG. 3 is a flowchart of a main routine executed in response to power-on of the coin handling mechanism 10. Upon power-on, predetermined initializing operations are performed at step S1, which includes an operation for resetting the stock setting flag F to "0" and an operation for resetting to a predetermined value (e.g., "0") the count of the incoming/outgoing coin counter CNTn for each of the coin tubes.

"Step 2" in FIG. 3 collectively represents operations for controlling normal reception and payout of coins, which, however, will not be described in detail since these operations are not an essential part of the present invention. When one or more coins have been received or stored into any one of the coin tubes or one or more coins are to be paid out from any one of the coin tubes, predetermined operations are first performed at this step S2 and then control proceeds to next step S3. If no coin has been deposited and stored or no coin is to be paid out, control immediately goes from step S1 to step S3.

At step S3, it is determined, on the basis of the output signal from the cassette attachment/detachment sensor 15, whether or not the coin storage device 12 has been detached from the body frame of the coin handling mechanism (cassette detachment event), i.e., whether or not the output from the sensor 15 has changed from "cassette ON" to "cassette OFF". With an affirmative determination, control goes to step S4 to carry out a "cassette detachment process" as will be later described in detail. Namely, if the coin storage device 12 has been detached from the body frame of the coin handling mechanism as determined at step S3, the incoming/outgoing coin counter CNTn for each of the coin tubes A to D is reset to a predetermined value (e.g., "0"), and the stock setting flag F is also reset to "0" (step S41 of FIG. 4).

At next step S5, it is determined, on the basis of the output signal from the cassette attachment/detachment sensor 15 (cassette attachment event), whether or not the coin storage device 12 has been attached to the coin handling mechanism 10, i.e., whether or not the output from the sensor 15 has changed from "cassette OFF" to "cassette ON". With an affirmative determination, control goes to step S6 to carry out a "cassette attachment process" as will be later described in detail in connection with FIG. 5. Namely, if the coin storage device 12 has been attached to the coin handling mechanism 10 as determined at step S5, the stock setting flag F is set to "1" (step S61 of FIG. 5).

At next step S7, an operation is performed, in response to the coin reception or payout of FIG. 2, to increment by one the count of the incoming/outgoing coin counter CNTn for the coin tube to which the deposited coin has been supplied (or received) or to decrement by one the count of the counter CNTn for the tube from which the coin has been paid out.

In this way, for each of the coin tubes A to D of the coin storage device 12, the number of coin or coins received therein or paid out therefrom is added to or subtracted from the count of the counter CNTn. If no coin has been supplied (or received) or paid out into or from any of the coin tubes A to D, control jumps over step S7 to step S8. Note that when a deposited coin overflows from the corresponding coin tube and is deflected into the cash box due to the fact that the coin tube has already been filled to its full capacity, the count of the counter CNTn for the coin tube is of course not incremented by one.

At step S8, a determination is made as to whether the predetermined-amount-of-change maintaining switch 18 has been activated or not. With a negative determination at step S8, the main routine is repeated, while with an affirmative determination at step S8, control proceeds to step S9 to perform the predetermined-amount-of-change maintaining" process as will be later described in detail in connection with FIG. 6.

Next, exemplary operation of the coin handling mechanism 10 will be described. Assume that an appropriate quantity of coins are manually supplied and prestored in each of the coin tubes A to D of the coin storage device 12 to prevent any of the coin tubes, storing such coins for use as change to be returned to purchasers, from running short of change from the very beginning. Because detachment and re-attachment of the cassette of the coin storage device 12 take place at the time of this manual coin supply, the cassette detachment and attachment processes of steps S4 and S6 (FIGS. 4 and 6) are executed, so that the incoming/outgoing coin counter CNTn for each denomination (i.e., for each of the coin tubes) is reset to "0" and the stock setting flag F is set to "1" after being temporarily reset to "0". Although the count of the incoming/outgoing coin counter CNTn for each denomination is "0" which does not agree with the quantity of the coins being actually stored in the corresponding coin tube of the coin storage device 12 (as an initially-stored quantity or initial reserves), no particular would inconvenience occurs in this case. Namely, an exact value of the initially stored quantity (x) need not be known because the coin counter CNTn is intended to count the incoming/outgoing coins from this unknown initially stored quantity (x) as a starting point.

When a coin is deposited and supplied or received into one of the coin tubes A to D for the denomination of the deposited coin during the normal operation of the coin handling mechanism, the count of the incoming/outgoing coin counter CTNn for that denomination is incremented by one at step S7. On the other hand, when a coin is paid out from one of the coin tubes A to D of the coin storage device 12, the count of the incoming/outgoing coin counter CNTn for the denomination of the paid-out coin is decremented by one at step S7. This way, the incoming/outgoing coin counter CNTn operates to accumulatively count a difference between the numbers of incoming (supplied or received) and outgoing (paid-out or issued) coins in the corresponding coin tube. The coin payout from any of the coin tubes A to D may be detected by a conventionally-known means, such as a control signal for a denomination-specific payout solenoid control signal, a carrier switch activating signal for a payout motor or an output signal from a payout detecting switch.

Then, once the machine managing person activates or turns ON the predetermined-amount-of-change maintaining switch 18 for proceeds management, an affirmative determination results at step S8 of FIG. 3, so that the predetermined-amount-of-change maintaining process is initiated at step S9 in order to permit only a predetermined or appropriate quantity of the coins to be left stored in the coin storage device 12 and automatically dislodge the other or excess coins from the storage device 12.

Figure 6:
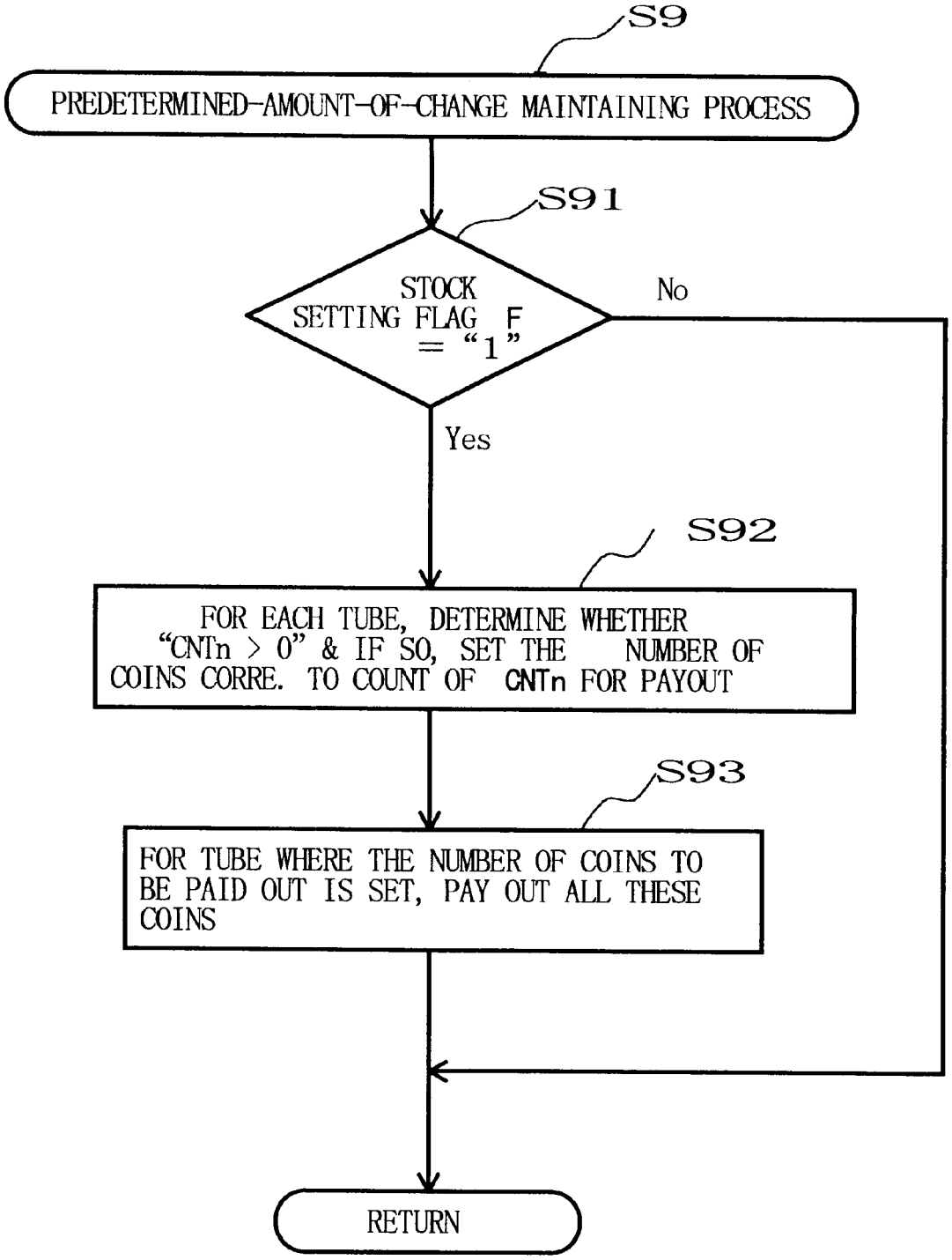
FIG. 6 is a flowchart illustrating a detailed example of a predetermined-amount-of-change maintaining process of FIG. 3.

Describing in more detail the predetermined-amount-of-change maintaining process with reference to FIG. 6, a determination is first made at step S91 as to whether or not the stock setting flag F is at "1". Because the flag F has been set to "1" in response to attachment of the coin storage device cassette 12 in the last coin collection unless there was no power failure during the operation, an affirmative determination results at step S91, so that control proceeds to next step S92.

At step S92, a determination is made, for each of the coin tube, as to whether the count of the incoming/outgoing coin counter CNTn is greater than the initially-reset predetermined value, i.e., "0" in this case. If so, the number of coins corresponding to the difference (i.e., corresponding to the current counted value of the counter CNTn if the initially-reset predetermined value is "0" as in this case) is set to be paid out from the corresponding coin tube. Then, at next step S93, the number of coins set at the preceding step are automatically paid out from the coin tube.

If the count of the incoming/outgoing coin counter CNTn of the corresponding coin tube is assumed to be "M", this count M represents a difference between the number of coins supplied to the tube and the number of coins paid out from the tube. Thus, if the unknown value of the initially stored quantity is assumed to be "x", then the quantity of actually stored coins in the coin tube immediately before the payout operations of steps S92 and S93 is "x+M". Because a specific number of coins corresponding to the count M are automatically paid out through the operations of steps S92 and S93, the predetermined (but unknown) quantity of coins equivalent to the initially-stored quantity x will be left in the coin tube. In the above-mentioned manner, the managing person can readily perform the operations for automatically leaving the predetermined number (x) of coins in the tube and automatically paying out the other or excess coins for collection.

If the quantity of coins supplied to one of the coin tubes is not greater than the quantity of coins paid out therefrom and the determination of "CNTn>0" at step S92 becomes negative for that coin tube, the coin payout operation of step S93 is not performed.

For any of the coin tubes that has not satisfied the condition of "CNTn>0", it is very likely that the quantity of actually stored coins in the tube has decreased below the to-be-initially-stored quantity x and the tube has run short of coins to be used as change. Therefore, let's assume here that at the last stage of the coin collection or withdrawal operations, the machine managing person temporarily detaches the coin storage device cassette 12 from the body frame of the coin handling mechanism to visually ascertain the coin storing states of the individual coin tubes of the cassette 12. Let's also assume that using, as a manual coin-supplying standard, the visual mark put on each of the coin tubes at the particular vertical location thereof corresponding to the level of a predetermined quantity of coins to be stored, the managing person manually supplies any of the tubes, having run short of coins below the mark, with a given quantity of additional coins up to the mark. After that, the coin storage device cassette 12 is re-attached to the body frame of the coin handling mechanism. In response to the detachment and re-attachment, the processes of steps S41 and S61 (FIGS. 4 and 5) are executed to reset to a predetermined value (e.g., "0") the count of the incoming/outgoing coin counter CNTn for each of the coin tubes and to also set the stock setting flag F to "1".

Preferably, the visual mark, put on each of the coin tubes at the particular location corresponding to the level of a predetermined quantity of coins to be stored in the coin tube, is made of an adhesive colored tape or seal so that its position can be readily varied as desired. Thus, if the quantity of stored coins in a particular one of the coin tubes presents a considerably great decrease at the next inventorying collection, such a management can be executed to change the position of the mark in such a manner to raise the level of the predetermined quantity of coins to be stored.

In the event of a power failure during the normal operation of the coin handling mechanism, the initializing operations are performed at step Si upon recovery of power. Thus, when the predetermined-amount-of-change maintaining switch 18 is activated afterwards, a negative determination results at step S91 of FIG. 6, so that the the predetermined-amount-of-change maintaining process comes to an end without performing the operations of steps S92 and S93. This is because the count of the individual incoming/outgoing coin counter CNTn may have become inaccurate due to the power failure. In such a case, it is only necessary that when the coin storage device cassette 12 is detached from the body frame of the coin handling mechanism, the quantity of stored coins in each of the coin tube be visually ascertained so as to allow any excess coins to be collected from the tube or any insufficient coins to be additionally supplied to the tube in a manual fashion. However, such measures at the time of a power failure will be unnecessary in cases where the incoming/outgoing coin counters CNTn are backed up by an electric cell or implemented by a non-volatile memory.

Figure 5:
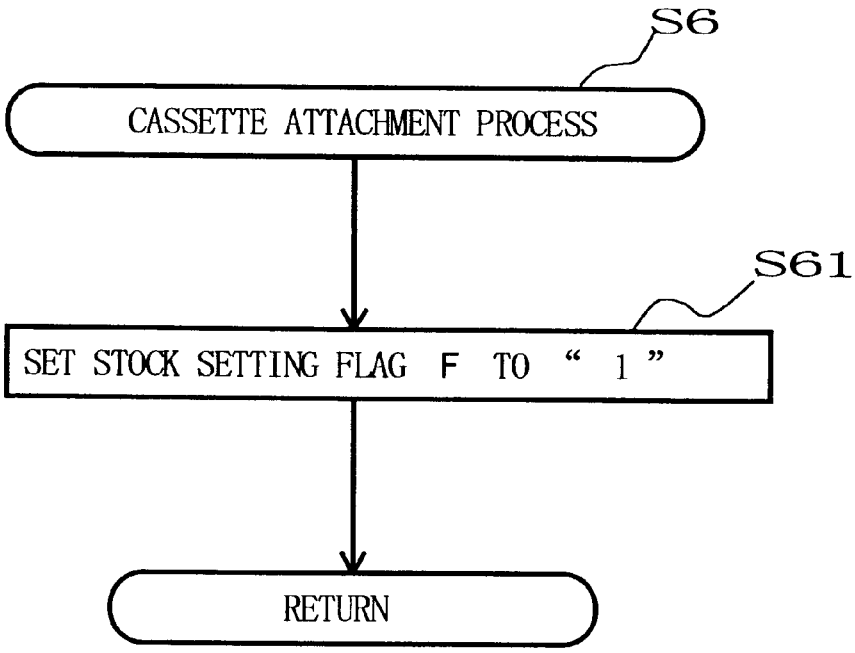
FIG. 5 is a flowchart illustrating a detailed example of a cassette attachment process of FIG. 3.
Figure 12:
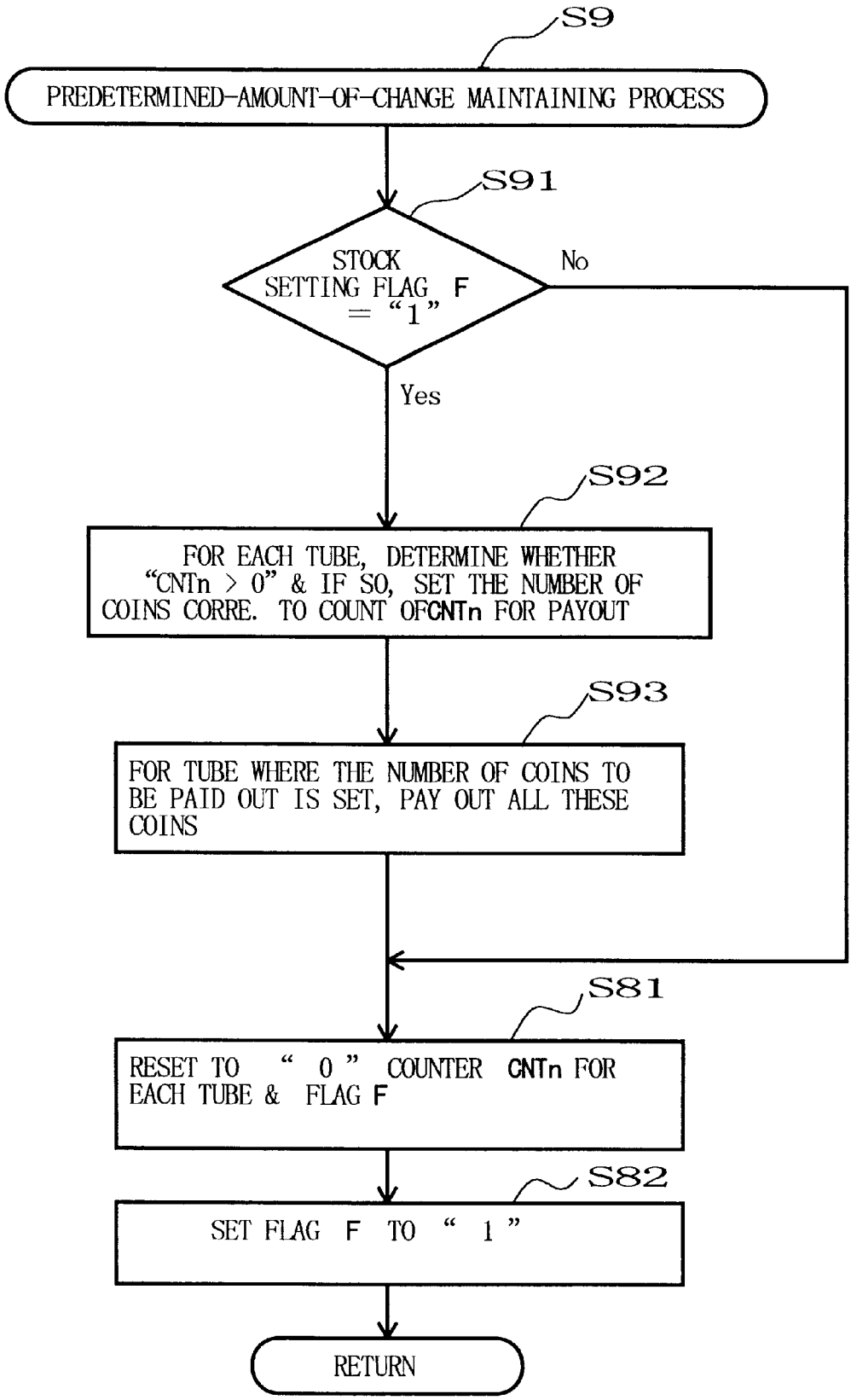
FIG. 12 is a flowchart showing a modification of the predetermined-amount-of-change maintaining process of FIG. 6.

FIG. 12 is a flowchart illustrating a modification of the predetermined-amount-of-change maintaining process described above in relation to FIG. 6. In FIG. 12, operations of steps S91 to S93 are similar to those of the same step numbers in FIG. 6, and operations of steps S81 and S82 are newly added here to be executed after step S93 or when a negative determination results at step S91. At step S81, similar to step S41 in FIG. 4, the incoming/outgoing coin counter CNTn of each of the coin tubes A to D is reset to a predetermined value (e.g., "0"), and the stock setting flag F is also reset to "0". At step S82, similar to step S61 in FIG. 5, the stock setting flag F is set to "1". Namely, this modified predetermined-amount-of-change maintaining process of FIG. 12 is characterized in that the operations of steps S81 and S82, similar to the "cassette detachment process" of FIG. 4 and the "cassette attachment process" of FIG. 5, are automatically performed, at the end of the predetermined-amount-of-change maintaining process, without the detachment and re-attachment of the cassette having to be actually done. As a consequence, this modification eliminates the labor to temporarily detach the cassette 12 and then re-attach the cassette 12 to the body frame of the coin handling mechanism. That is, while the example of FIG. 6 requires the labor to temporarily detach the cassette 12 and then re-attach the cassette 12 to the body frame of the coin handling mechanism, the example of FIG. 12 does not require it at all. Thus, where the example of FIG. 12 is employed, the cassette attachment/detachment sensor 15 can be omitted, and steps S3 to S6 of FIG. 3 may be omitted.

In the example of FIG. 12, supply of necessary additional coins to the individual coin tubes A to D of the coin storage device cassette 12 may be done in a similar manner to the example of FIG. 6, i.e., by temporarily detaching the cassette 12 to manually supply the additional coins to any of the coin tubes in need and then re-attaching the cassette 12 to the body frame of the coin handling mechanism. Alternatively, the supply of necessary additional coins may be implemented by manually depositing a necessary number of coins of one or more necessary denominations through the coin inlet 14 (or a coin slot preceding the coin inlet 14) while visually ascertaining the coin storing states of the individual coin tubes, without the coin storage device cassette 12 being actually detached from the body frame of the coin handling mechanism 10.

Figure 13:
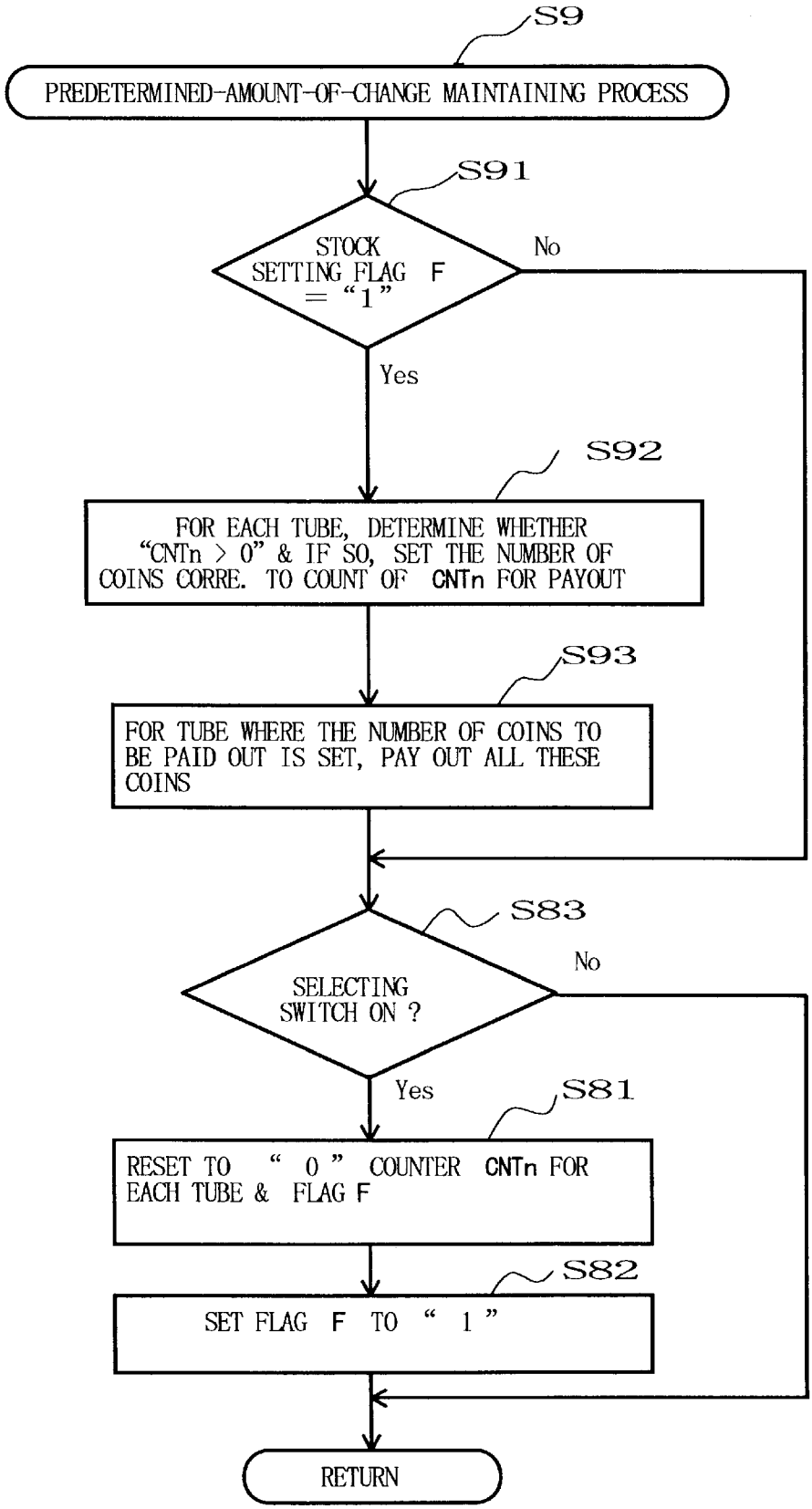
FIG. 13 is a flowchart illustrating a modification of the predetermined-amount-of-change maintaining process of FIG. 12.

The predetermined-amount-of-change maintaining process of FIG. 12 may be modified, as shown in FIG. 13, to further include step S83 to determine whether or not a predetermined selecting switch (not shown) has been activated. If determined in the affirmative at step S83, the operations of steps S81 and S82 are executed; otherwise, control returns to the main routine without performing the operations of steps S81 and S82. Thus, when the coin storage device cassette 12 is to be temporarily detached for manual supply of additional coins to any of the coin tubes, it is possible to prevent the operations of steps S81 and S82 from being executed, by leaving the predetermined selecting switch deactivated or OFF. In such a case, the modification of FIG. 13 will operate in a similar manner to the embodiment of FIG. 6. When, on the other hand, the coin storage device cassette 12 is to not be detached, the predetermined selecting switch is activated or turned ON so as to carry out the operations of steps S81 and S82.

Now, a description will be made hereinbelow about a preferred embodiment according to a second aspect of the present invention, where all the components of the coin handling mechanism 10 shown in FIG. 1 can be employed. This second embodiment is designed to improve the accuracy in managing the quantity of stored coins via the incoming/outgoing coin counters CNTn, by use of the respective full-capacity sensors 16*a* to 16*d* as well as the change shortage sensors 17*a* to 17*d*.

Figure 7:
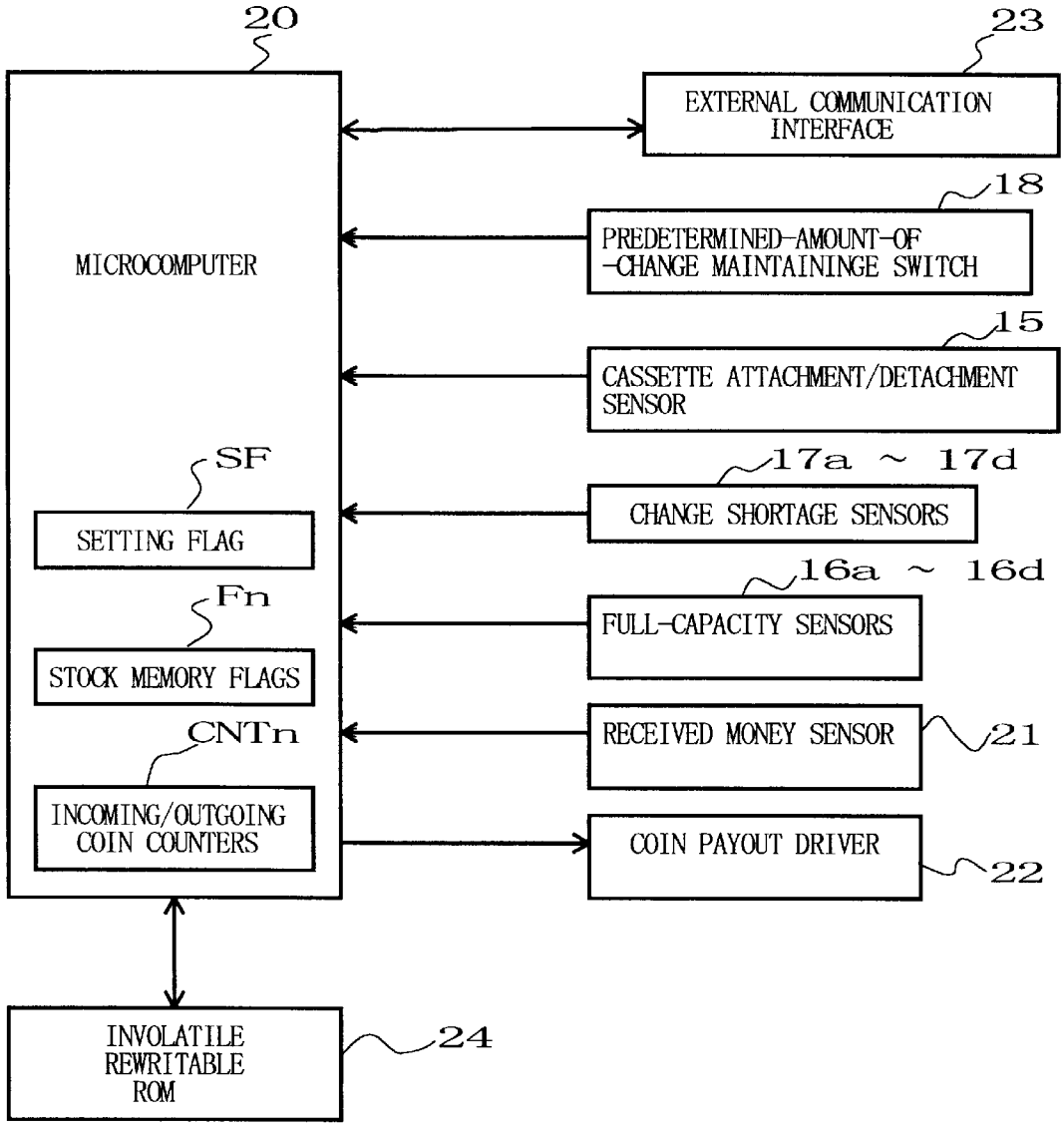
FIG. 7 is a block diagram illustrating an overall hardware structure of control circuitry in accordance with a second embodiment of the present invention built in the coin handling mechanism of FIG. 1.

FIG. 7 is a block diagram illustrating control circuitry which is used to practice the second embodiment. The control circuitry of FIG. 7 is similar to that of FIG. 2 but different therefrom in that a non-volatile rewritable ROM 24 is provided for use by the microcomputer 20.

The non-volatile rewritable ROM 24 is for prestoring appropriate coin-stock prescribing values Kn each indicative of a quantity of coins to be initially stored as an appropriate stock for use as change to be returned to purchasers. Specifically, different appropriate coin-stock prescribing values Kn may be set the individual coin tubes, and numerical values representative of the values Kn are prestored in the ROM 24. In the above-described first embodiment of the present invention, the actual quantity of coins to be initially stored x, for each of the coin tubes, does not necessarily agree with the predetermined value (e.g., "0") to be reset (preset) in the incoming/outgoing coin counter CNTn. In contrast, in the second embodiment, the appropriate-stock prescribing value Kn and the actual quantity of coins to be initially stored x, for each of the coin tubes, agree with or generally correspond to each other; that is, the actual quantity x and the value (first predetermined value) are allowed to agree with or generally correspond to each other by retrieving the numerical value representative of the prescribing value Kn from the ROM 24 and presetting the prescribing value Kn in the incoming/outgoing coin counter CNTn.

FIGS. 8 to 11 are flow charts of control sequences to be used to practice the above-mentioned second embodiment.

Figure 8:
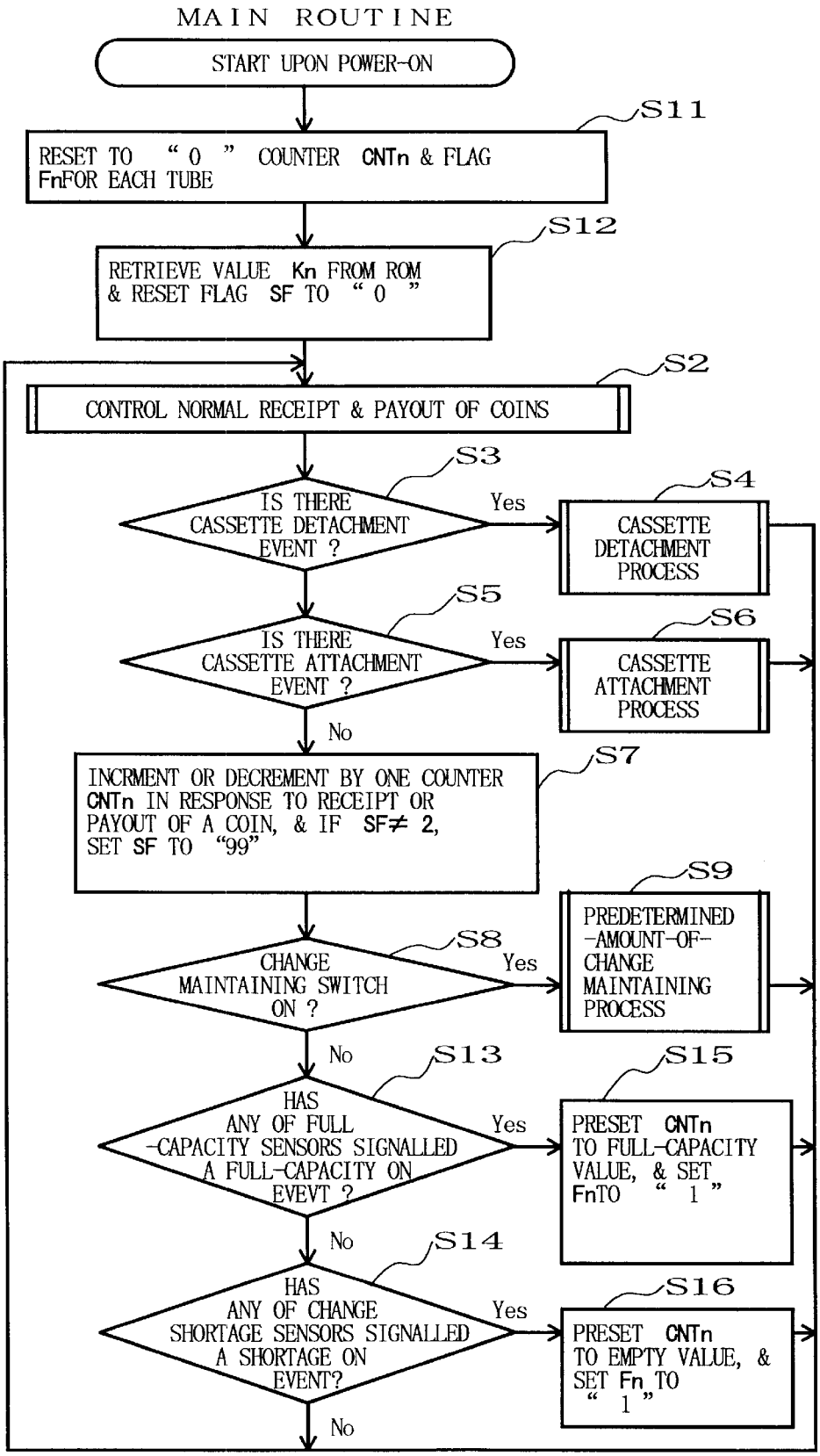
FIG. 8 is a flowchart showing an example of a main routine executed by a microcomputer of FIG. 7.
Figure 9:
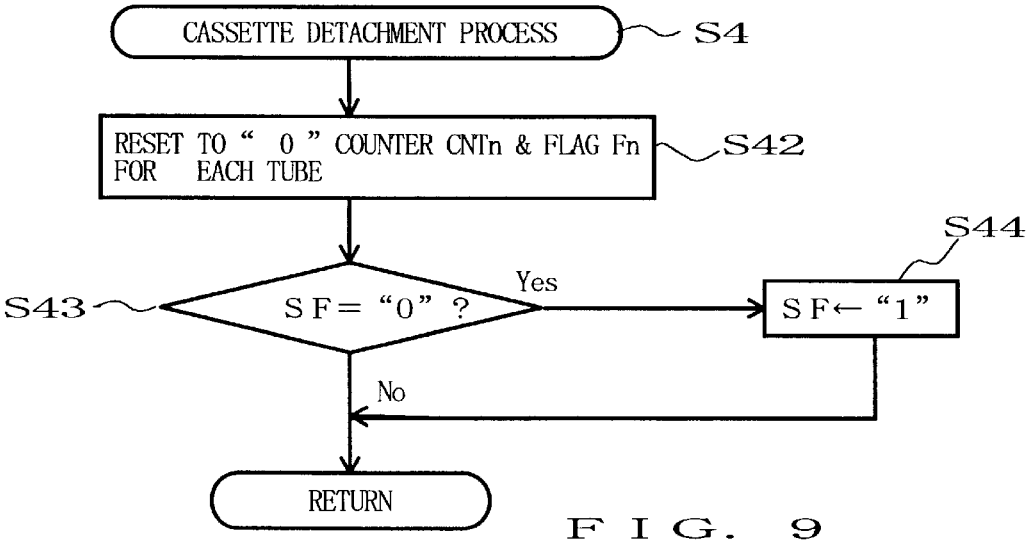
FIG. 9 is a flowchart illustrating a detailed example of a cassette detachment process of FIG. 8.
Figure 10:
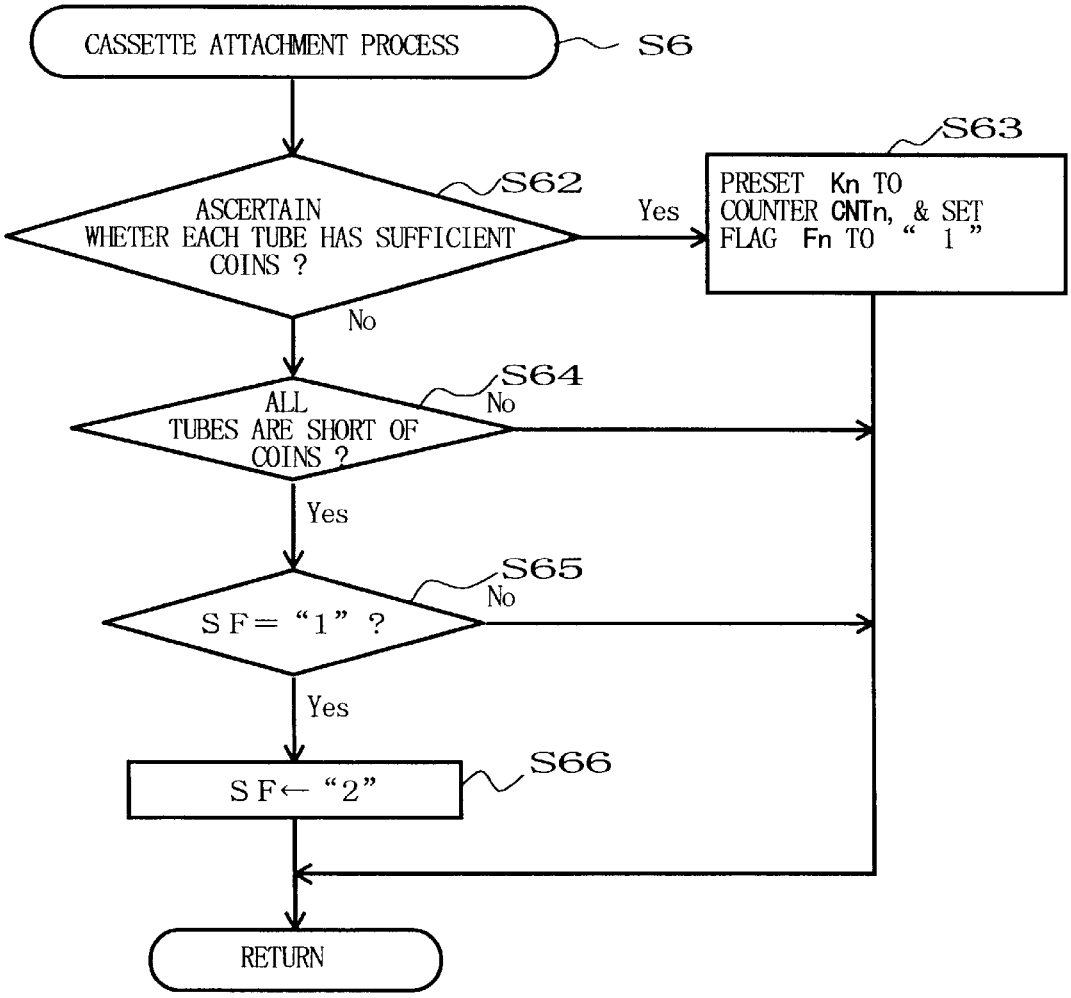
FIG. 10 is a flowchart illustrating a detailed example of a cassette attachment process of FIG. 8.
Figure 11:
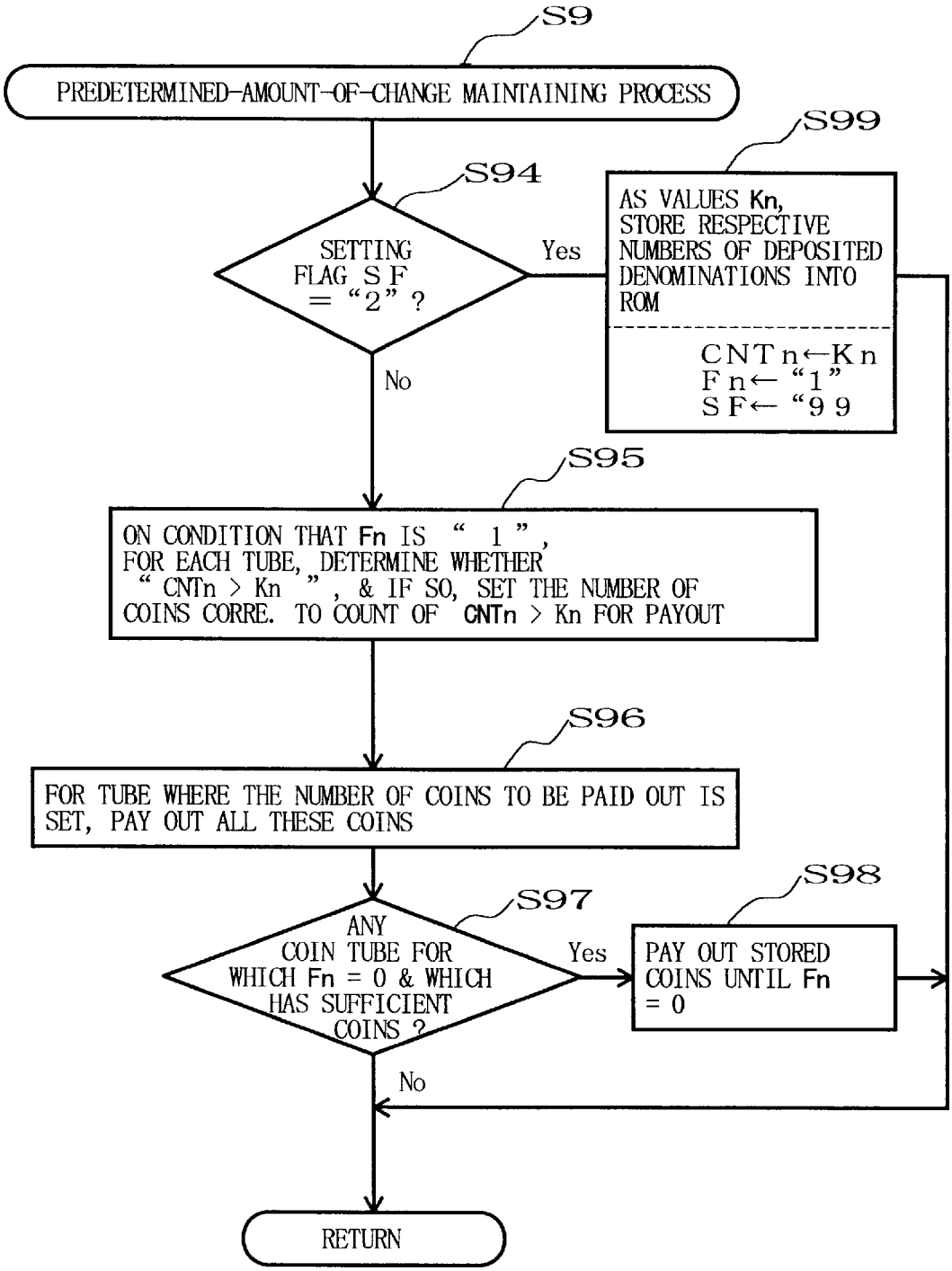
FIG. 11 is a flowchart illustrating a detailed example of a predetermined-amount-of-change maintaining process of FIG. 8.

More specifically, FIG. 8 is a flowchart showing an example of a main routine activated upon power-on in the coin handling mechanism, where steps performing operations similar to those of FIG. 3 are denoted by the same step numbers as in FIG. 3. FIG. 9 is a flowchart showing a detailed example of a cassette detachment process at step S4 of FIG. 8, FIG. 10 is a flowchart showing a detailed example of a cassette attachment process at step S6 of FIG. 8, and FIG. 11 is a flowchart showing a detailed example of a predetermined-amount-of-change maintaining process at step S9 of FIG. 8.

Upon power-on, predetermined initializing operations are performed at step S11 and S12 of FIG. 8. Step S11 resets to a value "0" the incoming/outgoing coin counter CNTn for each of the coin tubes and resets to "0" a stock memory flag Fn for each of the coin tubes. At step S12, the appropriate coin-stock prescribing values Kn for the individual coin tubes are retrieved from the non-volatile rewritable ROM 24 and temporarily stored into a register, and a setting flag SF is reset to "0". The stock setting flag SF is for managing operations to set the appropriate coin-stock prescribing values Kn.

At steps S3 to S6 of FIG. 8, the cassette detachment process or cassette attachment process is performed in response to detection of the cassette detachment or cassette attachment event in the coin storage device 12, in a similar manner to steps S3 to S6 of FIG. 3. However, as shown in FIGS. 9 and 10, details of the cassette detachment process and cassette attachment process are somewhat different from those of FIGS. 4 and 5.

In the cassette detachment process of FIG. 9, the incoming/outgoing coin counter CNTn and stock memory flag Fn for each of the coin tubes A to D are first reset to "0" at step S42. At next step S43, a determination is made as to whether the setting flag SF is currently at "0". If answered in the negative at step S43, the cassette detachment process comes to an end, but if answered in the affirmative, control goes to step S44 to change the value of the setting flag SF to "1".

In the cassette attachment process of FIG. 10, the output signal from the change shortage sensor 17*a*–17*d* for each of the individual coin tubes A to D is checked, and an operation of step S63 is performed on each of the coin tubes for which an affirmative determination (indicating that it contains more coins to be used as change than a predetermined change shortage level) results at step S62. However, the operation of step S63 is not performed on each of the coin tubes which contains less coins to be used as change than the predetermined change shortage level. At step S63, for each of the coin tubes which has been determined as containing more coins to be used as change than the predetermined change shortage level, the above-mentioned appropriate coin-stock prescribing value Kn (first predetermined value) is preset as the count of the corresponding incoming/outgoing coin counter CNTn, and the corresponding stock memory flag Fn is set to "1".

At step S64, it is ascertained whether or not all the coin tubes are short of coins to be used as change ("out of change"). In answered in the affirmative, control proceeds to step S65 to further determine whether or not the setting flag SF is currently at "1". With an affirmative determination, control moves on to step S66 to change the value of the setting flag SF to "2".

Referring back to FIG. 8, at step S7, the incoming/outgoing coin counters CNTn are incremented or decremented by one in response to incoming (supplied or received) or outgoing (paid-out or issued) of a coin, in a similar manner to step S7 of FIG. 3. In addition, if the setting flag SF is not currently at "2", a flag management is performed to change the flag value to "99".

Once it is detected that the predetermined-amount-of-change maintaining switch 18 has been activated, an affirmative determination results at step S8, so that control goes to step S9 in order to carry out the predetermined-amount-of-change maintaining process as shown in FIG. 11.

At step S13 of FIG. 8, a determination is made as to whether any of the full-capacity sensors 16*a* to 16*d* has signalled a change to the full-capacity level (i.e., full-capacity ON event). If answered in the affirmative, control goes to step S15 in order to preset the count of the corresponding incoming/outgoing coin counter CNTn to a full-capacity prescribing value (second predetermined value) corresponding to a predetermined full-capacity position or level and to also set the corresponding stock memory flag Fn to "1".

At step S14 of FIG. 8, a determination is made as to whether any of the change shortage sensors 17*a* to 17*d* has signalled a change from the non-shortage level to the shortage level (i.e., shortage ON event). If answered in the affirmative, control goes to step S16 in order to preset the count of the corresponding incoming/outgoing coin counter CNTn to a shortage prescribing value (third predetermined value) corresponding to a predetermined shortage position or level and to also set the corresponding stock memory flag Fn to "1".

Next, exemplary operation of the second embodiment will be described below with reference to FIGS. 8 to 11.

First, a description will be made exemplary operations for setting an appropriate coin-stock prescribing value Kn for each denomination. These setting operations comprises temporarily detaching the coin storage device cassette 12 from the body frame of the coin handling mechanism to dislodge all stored coins from (i.e., empty) all the coin tubes, re-attaching the cassette 12 to the body frame of the coin handling mechanism and also turning ON the predetermined-amount-of-change maintaining switch 18, and then depositing, for each denomination, a specific number of coins that is to be set as an appropriate coin-stock prescribing value Kn.

During these setting operations, the cassette detachment process is performed in response to detection of the temporary cassette detachment as shown in FIG. 9, where the setting flag SF is set to "1" at step S44 after step S43 ascertains that the flag SF is at "0" at the time of the cassette detachment. Then, the cassette attachment process is performed in response to detection of the cassette re-attachment as shown in FIG. 10, where steps S62 and S64 ascertain that all the coin tubes are short of coins to be used as change and then control goes to step S65. Step S65 ascertains that the setting flag SF is at "1", and then step S66 sets the setting flag SF to "2". This way, the setting flag F is set to "2" during the operations for an appropriate coin-stock prescribing value Kn. Consequently, the predetermined-amount-of-change maintaining process of FIG. 11 is ready to start in response to activation (turning ON) of the predetermined-amount-of-change maintaining switch 18.

In the predetermined-amount-of-change maintaining process of FIG. 11, step S94 determines whether or not the setting flag SF is currently at "2". Because the the setting flag SF has now been set to "2", control goes to step S99. At step S99, the number of deposited coins, for each denomination, is stored into the non-volatile rewritable ROM 24 as an appropriate coin-stock prescribing value Kn of that denomination, and also preset into the corresponding incoming/outgoing coin counter CNTn. Also, step S99 sets all the stock memory flags Fn to "1" and changes the value of the setting flag SF to "99" in order to indicate that the operations for setting an appropriate stock prescribing value Kn have been completed for all the denominations. Note that when the stock memory flag Fn is set at "1" for a specific one of the coin tubes, it shows that the count of the incoming/outgoing coin counter CNTn for that specific coin tube is accurate to some degree.

In a similar manner to the above-described first embodiment, when a coin is deposited and supplied to one of the coin tubes A to D corresponding to the corresponding denomination during the normal operation of the coin handling mechanism, the count of the incoming/outgoing coin counter CTNn for that denomination is incremented by one at step S7. On the other hand, when a coin is paid out from one of the coin tubes A to D of the coin storage device 12, the count of the incoming/outgoing coin counter CNTn for the denomination of the paid-out coin is decremented by one at step S7. This way, each of the incoming/outgoing coin counters CNTn for the coin tubes A to D operates to accumulatively count a difference between the numbers of incoming and outgoing coins in the corresponding coin tube.

Once any of the full-capacity sensors 16*a* to 16*d* detects that the quantity of stored coins in any of the coin tubes has reached the full-capacity level during the normal operation of the coin handling mechanism, an affirmative determination results at step S13, so that step S15 presets the count of the corresponding incoming/outgoing coin counter CNTn to a full-capacity prescribing value (second predetermined value) corresponding to the predetermined full-capacity position and also sets the corresponding stock memory flag Fn to "1".

Further, once any of the change shortage sensors 17*a* to 17*d* detects that the quantity of stored coins in any of the coin tubes has reached the empty (shortage or "out-of-change") level during the normal operation of the coin handling mechanism, an affirmative determination results at step S14, so that step S16 presets the count of the corresponding incoming/outgoing coin counter CNTn to a shortage prescribing value (third predetermined value) corresponding to the predetermined shortage level and also set the corresponding stock memory flag Fn to "1".

Thus, using the detection signals from the full-capacity sensors 16*a* to 16*d* and change shortage sensors 17*a* to 17*d*, presetting operations can be performed in such a manner that the incoming/outgoing coin counters CNTn for the individual coin tubes can each show the quantity of coins currently stored therein with considerable accuracy.

Then, once the machine managing person activates or turns ON the predetermined-amount-of-change maintaining switch 18 for proceeds management, an affirmative determination results at step S8 of FIG. 8, so that the predetermined-amount-of-change maintaining process is performed at step S9. Basically, in the predetermined-amount-of-change maintaining process of FIG. 11, only a predetermined or appropriate quantity of the coins are left stored, as coins to be used change, in the coin storage device 12 and the other or excess coins are automatically dislodged from the storage device 12, in a similar manner to the counterpart of FIG. 6. However, the second embodiment is different from the first embodiment in that an appropriate coin-stock prescribing value Kn is preset for each of the coin tubes to allow the above-mentioned determinations to be made on the basis of the value Kn.

More specifically, on condition that the stock memory flag Fn is at "1", step S95 of FIG. 11 determines, for each of the tubes, whether or not the count of the corresponding incoming/outgoing coin counter CNTn is greater than the initially-set first predetermined value, i.e., appropriate coin-stock prescribing value Kn. If answered in the affirmative, step S95 sets, for subsequent payout, the number of coins corresponding to the determined difference "CNTn−Kn". Then, at next step S96, the number of coins set at the preceding step are automatically paid out from the coin tube.

If the count of the incoming/outgoing coin counter CNTn for a specific one of the coin tubes is "Kn +M", the value "M" represents a difference between the numbers of received coins and paid-out coins in the coin tube, similarly to the above-mentioned. Because the number of coins corresponding to "CNTn−Kn=M" are automatically paid out from the coin tube, a specific number of coins as indicated by the prescribing value Kn equivalent to the to be-initially-stored quantity will be left stored in the coin tube. In the above-mentioned manner, the managing person can readily perform the operations for automatically leaving a specific number of coins indicated by the appropriate coin-stock prescribing value Kn in the tube and automatically paying out the other or excess coins for collection or withdrawal.

If the quantity of coins supplied to or received in a specific one of the coin tubes is greater than the quantity of coins paid out therefrom and the determination of "CNTn>Kn" at step S95 becomes negative for that coin tube, the coin payout operation of step S96 is not performed.

Further, as previously mentioned, for any of the coin tubes that has not satisfied the condition of "CNTn>Kn" as determined at step S95, it is very likely that the quantity of actually stored coins in the tube has decreased below the appropriate coin-stock prescribing value Kn and the tube is short of coins to be used as change. Therefore, let's assume that the machine managing person temporarily detaches the coin storage device cassette 12 from the body frame of the coin handling mechanism to visually examine the coin storing state of the coin tube of the cassette 12. Let's also assume that using, as a manual coin-supplying standard, the visual mark put on each of the coin tubes at the particular vertical location thereof corresponding to the level of a predetermined quantity of coins to be stored one on another, the managing person manually supply any of the tubes, having run short of coins below the mark, with a given quantity of additional coins up to the mark. After that, the coin storage device cassette 12 is re-attached to the body frame of the coin handling mechanism. In response to the detachment and re-attachment of the coin storage device cassette 12, the processes of steps S42 (FIG. 9), S61 and S62 (FIG. 10) are executed, so that the count of the incoming/outgoing coin counters CNTn for the individual coin tubes are temporarily cleared, and the respective appropriate coin-stock prescribing values Kn are preset into the coin counters CNTn and the stock memory flags Fn are set to "1" after confirming that coins have been supplied more than the shortage levels.

In the event of a power failure during the normal operation of the coin handling mechanism, the initializing operations are performed at steps S1 and S12 upon recovery of power, which includes resetting the stock memory flags Fn to "0". Thus, when the predetermined-amount-of-change maintaining switch 18 is activated afterwards, control goes to step S97, without performing the operations of steps S95 and S96 of FIG. 11, now that the the stock memory flags Fn are at "0". At step S97, a determination is made as to whether there is any coin tube for which the stock memory flag Fn is at "0" and the change shortage sensor 17*a*–17*d* signals that there are sufficient coins to be used as change, i.e., "sufficient change". If answered in the affirmative at step S97, control goes to step S98, in order to automatically pay out the stored coins from that coin tube until the corresponding change shortage sensor 17*a*–17*d* signals that there are not sufficient coins to be used as change, i.e., a "change shortage".

Namely, even when there has been a power failure, the second embodiment allows the coins to be automatically paid out from the coin tube up to the change shortage level as long as the corresponding change shortage sensor 17*a*–17*d* signals "sufficient change", thus enhancing the coin collecting efficiency. In such a case, it is only necessary that when the coin storage device cassette 12 is detached from the body frame of the coin handling mechanism, the quantity of stored coins in each of the coin tube be visually ascertained using the mark as a manual coin-supplying standard so that any insufficient coins are additionally supplied to the tube in a manual fashion to reach the appropriate coin-stock prescribing value Kn. However, such measures at the time of a power failure are unnecessary in cases where the incoming/outgoing coin counters CNTn are backed up by an electric cell or implemented by a non-volatile memory.

Figure 14:
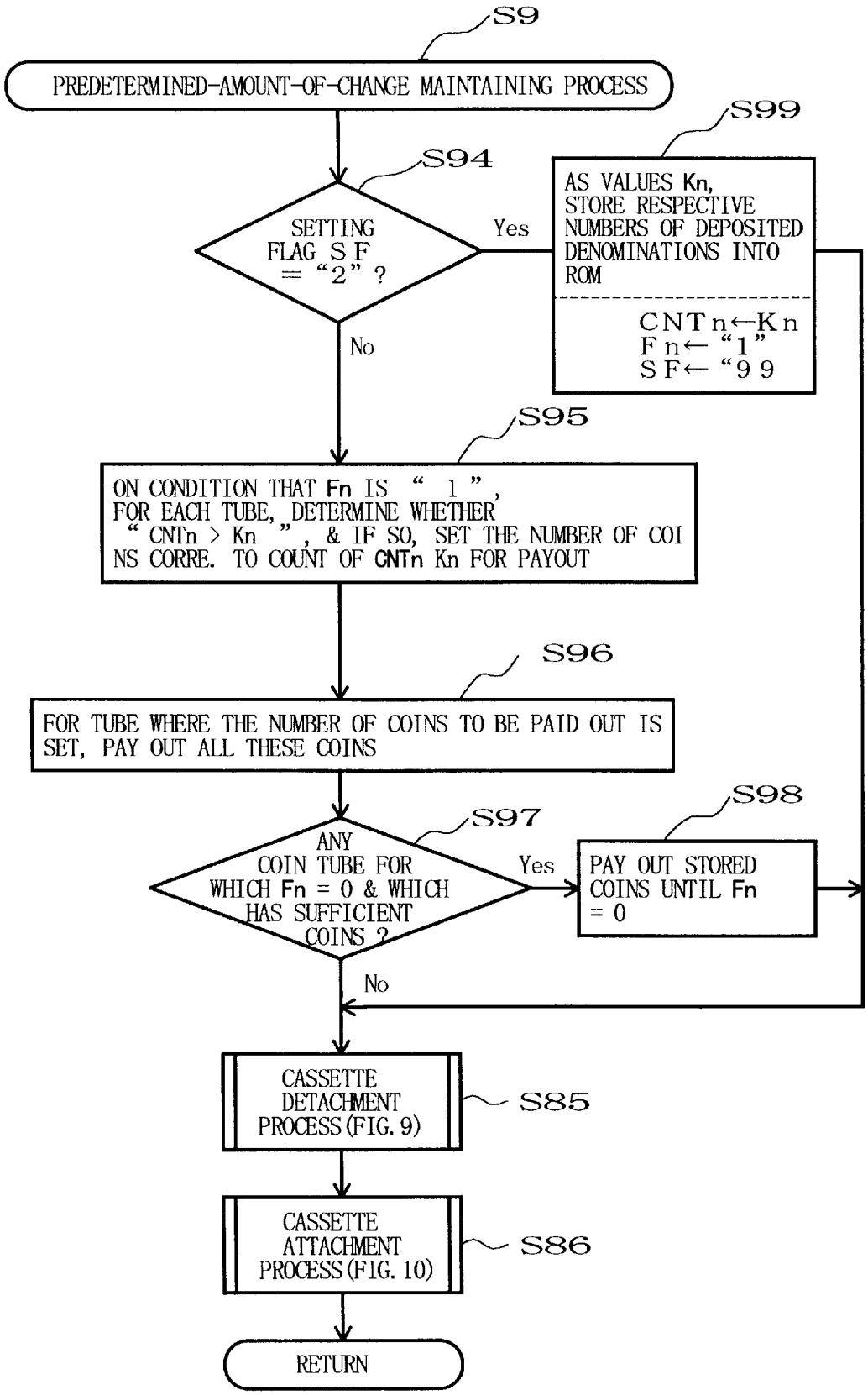
FIG. 14 is a flowchart illustrating a modification of the predetermined-amount-of-change maintaining process of FIG. 11.

FIG. 14 is a flowchart illustrating a modification of the predetermined-amount-of-change maintaining process described above in relation to FIG. 11. In FIG. 14, operations of steps S94 to S99 are similar to those of the same step numbers in FIG. 11, and operations of steps S85 and S86 are newly added to be executed after step S99 or when a negative determination results at step S97. At step S85, the "cassette detachment process" subroutine is executed as shown in FIG. 9, and at step S86, the "cassette attachment process" subroutine is executed as shown in FIG. 10.

Namely, this modification of FIG. 14 is characterized in that the "cassette detachment process" of FIG. 9 and the "cassette attachment process" of FIG. 10 are automatically performed, at the end of the predetermined-amount-of-change maintaining process routine, without the detachment and re-attachment of the cassette having to be actually done. As a consequence, this modification eliminates the labor to temporarily detach the coin storage device cassette 12 and then re-attach the cassette 12 to the body frame of the coin handling mechanism. That is, while the example of FIG. 11 requires the labor to temporarily detach the coin storage device cassette 12 and then re-attach the cassette 12 to the body frame of the coin handling mechanism even when there is no need to manually supply additional coins to the device 12, the example of FIG. 14 does not require such a labor at all. Thus, where the example of FIG. 14 is employed, the cassette attachment/detachment sensor 15 can be omitted, and steps S3 to S6 of FIG. 8 may be omitted.

In the example of FIG. 14, supply of necessary additional coins to the individual coin tubes A to D of the coin storage device cassette 12 may be done in a similar manner to the example of FIG. 6, i.e., by temporarily detaching the cassette 12 from the body frame of the coin handling mechanism to manually supply the additional coins to any of the coin tubes in need and then re-attaching the cassette 12 to the body frame of the coin mechanism. Alternatively, the supply of necessary additional coins may be implemented by manually depositing a necessary number of coins of one or more necessary denominations through the coin inlet 14 (or the coin slot preceding the coin inlet 14) while visually examining the coin storing states of the individual coin tubes, without the coin storage device cassette 12 being detached from the body frame of the coin handling mechanism 10.

The predetermined-amount-of-change maintaining process of FIG. 14 may be modified, as previously described in relation to FIG. 13, to further include a step (corresponding to S83 of FIG. 13) to determine whether or not a predetermined selecting switch (not shown) has been activated. If determined in the affirmative at that step, the operations of steps S85 and S86 are executed; otherwise, control returns to the main routine without performing the operations of steps S85 and S86. Thus, when the coin storage device cassette 12 is to be temporarily detached for manual supply of additional coins to any of the coin tubes in need, it is possible to prevent the operations of steps S85 and S86 from being executed, by leaving the predetermined selecting switch deactivated or OFF. In such a case, the modification of FIG. 14 will operate in a similar manner to the embodiment of FIG. 11. When, on the other hand, the coin storage device cassette 12 is to not be detached, the predetermined selecting switch is activated or turned ON so as to carry out the operations of steps S85 and S86.

In the above-described second embodiment, the ROM 24 for storing appropriate coin-stock prescribing values Kn may be implemented by a replaceable memory, so as to eliminate the need for setting appropriate coin-stock prescribing values Kn by depositing coins. Further, respective appropriate coin-stock prescribing values Kn for the individual denominations may be set outside the automatic vending machine place in a suitable manner and transferred via the external communication interface 23 to the microcomputer 20 of the coin handling mechanism 10 for storage into the ROM 24. The ROM 24 may be replaced with a RAM backed up an electric cell.

Furthermore, parts of the above-described first and second embodiments may be combined in a suitable manner to provide various modified embodiments. For example, the operations of steps S97 and S98 of FIG. 11 may be applied to the predetermined-amount-of-change maintaining process of FIG. 6. In another alternative, the operations at various steps of FIGS. 3–6, 12 and 13, and FIGS. 8–11 and 13 may be partly combined to modify the described embodiments of the present invention.

In summary, the present invention is characterized in that when it is detected that the coin storage device has been temporarily detached from the body frame of the coin handling mechanism or at the end of the predetermined-amount-of-change maintaining process, the count of the incoming/outgoing coin counter means is automatically reset (initialized) to a predetermined value for use in subsequent calculation of the number of received or supplied (incoming) and paid-out (outgoing) coins. At the time of the collection of stored coins from the coin storage device or the supply of additional coins to the coin storage device, this characteristic arrangement greatly facilitates the management for constantly allowing a predetermined quantity of coins to be initially stored in the coin storage device in a presumptive manner, without the need to numerically set the to-be-initially-stored quantity or initial reserve level as in prior art. As a result, the machine managing person is allowed to perform necessary inventory and collection of the stored coins through very simple manual operations only on the coin handling mechanism.

Further, according to the second aspect of the present invention, the incoming/outgoing coin counter means is preset to the second predetermined value corresponding to the full-capacity level of the corresponding coin tube in response to detection of coins stored in the tube to its full capacity, and is preset to the third predetermined value corresponding to the empty or change shortage level of the corresponding coin tube in response to detection of the empty or coin-shortage state in the tube. Thus, once the stored coins have reached the full-capacity level or empty or change shortage level during normal operation of the coin handling mechanism, the the incoming/outgoing coin counter means is preset to the second or third predetermined value so that the count of the counter means is automatically modified to a value representative of an accurate quantity of stored coins, which would greatly enhance the accuracy in managing the quantity of the stored coins.

What is claimed is:

1. A stored-coin-quantity managing system for a coin handling mechanism including a detachable coin storage device, a mechanism for routing a deposited coin to the coin storage device for reception therein, a mechanism for paying out a stored coin from the coin storage device, and a detector for detecting that the coin storage device has been detached from the coin handling mechanism, said stored-coin-quantity managing system comprising:

a counter which counts an increase and decrease in a quantity of the stored coins in said coin storage device;

a count controller which performs control to reset a count of said counter to a predetermined value in response to said detector detecting that said coin storage device has been temporarily detached from said coin handling mechanism and to increment or decrement the count of said counter in response to subsequent reception or payout of a coin into or from said coin storage device;

a switch which is activated by a coin managing person; and a coin payout controller which, in response to activation of said switch by the coin managing person, determines a difference between a current counted value of said counter and said predetermined value and performs control to pay out from said coin storage device a specific number of the stored coins corresponding to the difference if a quantity of received coins is greater than a quantity of paid-out coins.

2. A stored-coin-quantity managing system as recited in claim 1 wherein said coin storage device includes a coin tube having a transparent wall portion to permit a visual inspection of an interior of said coin tube, and a visual mark is put on said coin tube at a given location thereof corresponding to a level of a predetermined quantity of coins to be stored in said coin tube, and which, when said coin tube runs short of the stored coins, allows additional coins to be manually supplied to said coin tube up to said predetermined quantity using the visual mark as a manual coin-supplying standard.

3. A stored-coin-quantity managing system as recited in claim 1 which further comprises:

a flag which operates on the basis of an output from said detector in such a manner that said flag is reset in response to detachment of said coin storage device from said coin handling mechanism but set in response to attachment of said coin storage device to said coin mechanism; and an initializing section which resets said flag upon turning-on of a power source, and wherein said coin payout controller performs said control to pay out a specific number of the stored coins corresponding to the difference, on condition that said flag is set.

4. A stored-coin-quantity managing system as recited in claim 1 wherein said coin storage device includes a plurality of coin tubes, and each of said control by said count controller and said coin payout controller is performed for each of said coin tubes.

5. A stored-coin-quantity managing system for a coin handling mechanism including a detachable coin storage device, a mechanism for routing a deposited coin to the coin storage device for reception therein, a mechanism for paying out a stored coin from the coin storage device, a first detector for detecting that the coin storage device has been detached from the coin handling mechanism, a second detector for detecting that a quantity of the stored coins in the coin storage device has increased to a predetermined full-capacity level, and a third detector for detecting that the quantity of the stored coins in the coin storage device has decreased to a predetermined empty level, said stored-coin-quantity managing system comprising:

a counter which counts an increase and decrease in the quantity of the stored coins in said coin storage device;

a first preset controller which presets a count of said counter to a predetermined first value in response to said first detector detecting that said coin storage device has been re-attached to said coin handling mechanism after being temporarily detached therefrom;

a second preset controller which presets the count of said counter to a predetermined second value corresponding to the full-capacity level in response to said second detector detecting that the quantity of the stored coins in the coin storage device has increased to the full-capacity level and which presets the count of said counter to a predetermined third value corresponding to the empty level in response to said third detector detecting that the quantity of the stored coins in the coin storage device has decreased to the empty level;

a count controller which performs control to increment or decrement the count of said counter in response to reception or payout of a coin into or from said coin storage device;

a switch which is activated by a coin managing person; and a coin payout controller which, in response to activation of said switch by the coin managing person, determines a difference between a current counted value of said counter and said predetermined first value and performs control to pay out from said coin storage device a specific number of the stored coins corresponding to the difference if a quantity of received coins is greater than a quantity of paid-out coins.

6. A stored-coin-quantity managing system as recited in claim 5 which further comprises:

a flag which operates on the basis of an output from said first detector in such a manner that said flag is reset in response to detachment of said coin storage device from said coin handling mechanism but set in response to attachment of said coin storage device to said coin handling mechanism; and an initializing section which resets said flag upon turning-on of a power source, said coin payout controller performing said control to pay out a specific number of the stored coins corresponding to the difference, on condition that said flag is set, said stored-coin-quantity managing system further comprising a second coin payout controller which, if said flag is in a reset state at a time of activation of said switch and said third detector has not detected an empty condition in said coin storage device, performs control to automatically pay out the stored coins from said coin storage device until said third detector detects the empty condition.

7. A stored-coin-quantity managing system as recited in claim 5 wherein said coin storage device includes a coin tube having a transparent wall portion to permit a visual inspection of an interior of said coin tube, and a visual mark is put on said coin tube at a location thereof corresponding to a level of a predetermined quantity of coins to be stored in said coin tube, and which, when said coin tube runs short of the stored coins, allows additional coins to be manually supplied to said coin tube up to the predetermined quantity using the visual mark as a manual coin-supplying standard.

8. A stored-coin-quantity managing system as recited in claim 5 which further comprises:

a flag which operates on the basis of an output from said detector in such a manner that said flag is reset in response to detachment of said coin storage device from said coin handling mechanism but set in response to attachment of said coin storage device to said coin mechanism; and an initializing section which resets said flag upon turning-on of a power source, and wherein said coin payout controller performs said control to pay out a specific number of the stored coins corresponding to the difference, on condition that said flag is set.

9. A stored-coin-quantity managing system as recited in claim 5 wherein said coin storage device includes a plurality of coin tubes, and each of the control by said count controller and said coin payout controller is performed for each of said coin tubes.

10. A stored-coin-quantity managing system for a coin handling mechanism including a detachable coin storage device, a mechanism for routing a deposited coin to the coin storage device for reception therein, and a mechanism for paying out a stored coin from the coin storage device, said stored-coin-quantity managing system comprising:

a counter which counts an increase and decrease in a quantity of the stored coins in said coin storage device;

a count controller which performs control to increment or decrement a count of said counter in response to reception or payout of a coin into or from said coin storage device;

a switch which is activated by a coin managing person;

a coin payout controller which, in response to activation of said switch by the coin managing person, determines a difference between a current counted value of said counter and a predetermined reset value and performs control to pay out from said coin storage device a specific number of the stored coins corresponding to the difference if a quantity of received coins is greater than a quantity of paid-out coins; and a reset controller which, after said difference is determined by said coin payout controller in response to activation of said switch, resets the counted value of said counter to the predetermined reset value.

11. A stored-coin-quantity managing system for a coin handling mechanism including a detachable coin storage device, a mechanism for routing a deposited coin to the coin storage device for reception therein, a mechanism for paying out a stored coin from the coin storage device, a first detector for detecting that a quantity of the stored coins in the coin storage device has increased to a predetermined full-capacity level, and a second detector for detecting that the quantity of the stored coins in the coin storage device has decreased to a predetermined empty level, said stored-coin-quantity managing system comprising:

a counter which counts an increase and decrease in the quantity of the stored coins in said coin storage device;

a counted value controller which performs control to increment or decrement the counted value of said counter in response to reception or payout of a coin into or from said coin storage device;

a switch which is activated by a coin managing person;

a coin payout controller which, in response to activation of said switch by the coin managing person, determines a difference between a current counted value of said counter and a predetermined first value and performs control to pay out from said coin storage device a specific number of the stored coins corresponding to the difference if a quantity of received coins is greater than a quantity of paid-out coins;

a first preset controller which, after said difference is determined by said coin payout controller in response to activation of said switch, presets the counted value of said counter to said predetermined first reset value; and a second preset controller which presets the counted value of said counter to a predetermined second value corresponding to the full-capacity level in response to said second detector detecting that the quantity of the stored coins in the coin storage device has increased to the full-capacity level and which presets the counted value of said counter to a predetermined third value corresponding to the empty level in response to said third detector detecting that the quantity of the stored coins in the coin storage device has decreased to the empty level.

12. A stored-coin-quantity managing method for a coin handling mechanism including a detachable coin storage device, a mechanism for routing a deposited coin to the coin storage device for reception therein, a mechanism for paying out a stored coin from the coin storage device, a detector for detecting that the coin storage device has been detached from the coin handling mechanism, a counter for counting an increase and decrease in a quantity of the stored coins in the coin storage device, and a managing switch, said stored-coin-quantity managing method comprising the steps of:

resetting a counted value of said counter to a predetermined value in response to said detector detecting that said coin storage device has been temporarily detached from said coin handling mechanism;

performing control to increment or decrement the counted value of said counter in response to reception or payout of a coin into or from said coin storage device; and in response to activation of said managing switch, determining a difference between a current counted value of said counter and said predetermined value and performing control to pay out from said coin storage device a specific number of the stored coins corresponding to the difference if a quantity of received coins is greater than a quantity of paid-out coins.

13. A stored-coin-quantity managing method for a coin handling mechanism including a detachable coin storage device, a mechanism for routing a deposited coin to the coin storage device for reception therein, a mechanism for paying out a stored coin from the coin storage device, a first detector for detecting that the coin storage device has been detached from the coin handling mechanism, a second detector for detecting that a quantity of the stored coins in the coin storage device has increased to a predetermined full-capacity level, a third detector for detecting that the quantity of the stored coins in the coin storage device has decreased to a predetermined empty level, a counter for counting an increase and decrease in a quantity of the stored coins in the coin storage device, and a managing switch, said stored-coin-quantity managing method comprising the steps of:

presetting a counted value of said counter to a predetermined first value in response to said first detector detecting that said coin storage device has been re-attached to said coin handling mechanism after being temporarily detached therefrom;

presetting the counted value of said counter to a predetermined second value corresponding to the full-capacity level in response to said second detector detecting that the quantity of the stored coins in the coin storage device has increased to the full-capacity level;

presetting the counted value of said counter to a predetermined third value corresponding to the empty level in response to said third detector detecting that the quantity of the stored coins in the coin storage device has decreased to the empty level;

performing control to increment or decrement the counted value of said counter in response to reception or payout of a coin into or from said coin storage device; and in response to activation of said managing switch, determining a difference between a current counted value of said counter and said predetermined first value and performing control to pay out from said coin storage device a specific number of the stored coins corresponding to the difference if a quantity of received coins is greater than a quantity of paid-out coins.

14. A stored-coin-quantity managing method for a coin handling mechanism including a detachable coin storage device, a mechanism for routing a deposited coin to the coin storage device for reception therein, a mechanism for paying out a stored coin from the coin storage device, a counter for counting an increase and decrease in a quantity of the stored coins in the coin storage device, and a managing switch, said stored-coin-quantity managing method comprising:

performing control to increment or decrement a counted value of said counter in response to reception or payout of a coin into or from said coin storage device;

in response to activation of said managing switch, determining a difference between a current counted value of said counter and a predetermined reset value and performing control to pay out from said coin storage device a specific number of the stored coins corresponding to the difference if a quantity of received coins is greater than a quantity of paid-out coins; and after said difference is determined in response to activation of said managing switch, resetting the counted value of said counter to the predetermined reset value.

15. A stored-coin-quantity managing method for a coin handling mechanism including a detachable coin storage device, a mechanism for routing a deposited coin to the coin storage device for reception therein, a mechanism for paying out a stored coin from the coin storage device, a first detector for detecting that a quantity of the stored coins in the coin storage device has increased to a predetermined full-capacity level, a second detector for detecting that the quantity of the stored coins in the coin storage device has decreased to a predetermined empty level, a counter for counting an increase and decrease in a quantity of the stored coins in the coin storage device, and a managing switch, said stored-coin-quantity managing method comprising:

performing control to increment or decrement a counted value of said counter in response to reception or payout of a coin into or from said coin storage device;

in response to activation of said managing switch, determining a difference between a current counted value of said counter and a predetermined first value and performing control to pay out from said coin storage device a specific number of the stored coins corresponding to the difference if a quantity of received coins is greater than a quantity of paid-out coins;

after said difference is determined by said coin payout controller in response to activation of said managing switch, presetting the counted value of said counter to said predetermined first value;

presetting the counted value of said counter to a predetermined second value corresponding to the full-capacity level in response to said second detector detecting that the quantity of the stored coins in the coin storage device has increased to the full-capacity level; and presetting the counted value of said counter to a predetermined third value corresponding to the empty level in response to said third detector detecting that the quantity of the stored coins in the coin storage device has decreased to the empty level.

16. A machine-readable recording medium containing a group of program codes to cause said machine to manage a quantity of stored coins in a coin handling mechanism including a detachable coin storage device, a mechanism for routing a deposited coin to the coin storage device for reception therein, a mechanism for paying out a stored coin from the coin storage device, a detector for detecting that the coin storage device has been detached from the coin handling mechanism, a counter for counting an increase and decrease in a quantity of the stored coins in the coin storage device, and a managing switch, said machine-readable recording medium comprising:

a program code mechanism configured to reset a counted value of said counter to a predetermined value in response to said detector detecting that said coin storage device has been temporarily detached from said coin handling mechanism;

a program code mechanism configured to increment or decrement the counted value of said counter in response to reception or payout of a coin into or from said coin storage device; and a program code mechanism configured to, in response to activation of said managing switch, determine a difference between a current counted value of said counter and said predetermined value and perform control to pay out from said coin storage device a specific number of the stored coins corresponding to the difference if a quantity of received coins is greater than a quantity of paid-out coins.

17. A machine-readable recording medium containing a group of program codes to cause said machine to manage a quantity of stored coins in a coin handling mechanism including a detachable coin storage device, a mechanism for routing a deposited coin to the coin storage device for reception therein, a mechanism for paying out a stored coin from the coin storage device, a first detector for detecting that the coin storage device has been detached from the coin handling mechanism, a second detector for detecting that a quantity of the stored coins in the coin storage device has increased to a predetermined full-capacity level, a third detector for detecting that the quantity of the stored coins in the coin storage device has decreased to a predetermined empty level, a counter for counting an increase and decrease in a quantity of the stored coins in the coin storage device, and a managing switch, said recording medium comprising:

a program code mechanism configured to preset a counted value of said counter to a predetermined first value in response to said first detector detecting that said coin storage device has been re-attached to said coin handling mechanism after being temporarily detached therefrom;

a program code mechanism configured to preset the counted value of said counter to a predetermined second value corresponding to the full-capacity level in response to said second detector detecting that the quantity of the stored coins in the coin storage device has increased to the full-capacity level;

a program code mechanism configured to preset the counted value of said counter to a predetermined third value corresponding to the empty level in response to said third detector detecting that the quantity of the stored coins in the coin storage device has decreased to the empty level;

a program code mechanism configured to perform control to increment or decrement the counted value of said counter in response to reception or payout of a coin into or from said coin storage device; and a program code mechanism configured to, in response to activation of said managing switch, determine a difference between a current counted value of said counter and said predetermined first value and perform control to pay out from said coin storage device a specific number of the stored coins corresponding to the difference if a quantity of received coins is greater than a quantity of paid-out coins.

18. A machine-readable recording medium containing a group of program codes to cause said machine to manage a quantity of stored coins in a coin handling mechanism including a detachable coin storage device, a mechanism for routing a deposited coin to the coin storage device for reception therein, a mechanism for paying out a stored coin from the coin storage device, a counter for counting an increase and decrease in a quantity of the stored coins in the coin storage device, and a managing switch, said machine-readable recording medium comprising:

a program code mechanism configured to perform control to increment or decrement a counted value of said counter in response to reception or payout of a coin into or from said coin storage device;

a program code mechanism configured to, in response to activation of said managing switch, determine a difference between a current counted value of said counter and a predetermined reset value and perform control to pay out from said coin storage device a specific number of the stored coins corresponding to the difference if a quantity of received coins is greater than a quantity of paid-out coins; and a program code mechanism configured to, after said difference is determined in response to activation of said managing switch, reset the counted value of said counter to the predetermined reset value.

19. A machine-readable recording medium containing a group of program codes to cause said machine to manage a quantity of stored coins in a coin handling mechanism including a detachable coin storage device, a mechanism for routing a deposited coin to the coin storage device for reception therein, a mechanism for paying out a stored coin from the coin storage device, a first detector for detecting that a quantity of the stored coins in the coin storage device has increased to a predetermined full-capacity level, a second detector for detecting that the quantity of the stored coins in the coin storage device has decreased to a predetermined empty level, a counter for counting an increase and decrease in a quantity of the stored coins in the coin storage device, and a managing switch, said machine-readable recording mediums comprising:

a program code mechanism configured to perform control to increment or decrement a counted value of said counter in response to reception or payout of a coin into or from said coin storage device;

a program code mechanism configured to, in response to activation of said managing switch by the coin managing person, determine a difference between a current counted value of said counter and a predetermined first value and performing control to pay out from said coin storage device a specific number of the stored coins corresponding to the difference if a quantity of received coins is greater than a quantity of paid-out coins;

a program code mechanism configured to, after said difference is determined by said coin payout controller in response to activation of said managing switch, preset the counted value of said counter to said predetermined first value;

a program code mechanism configured to preset the counted value of said counter to a predetermined second value corresponding to the full-capacity level in response to said second detector detecting that the quantity of the stored coins in the coin storage device has increased to the full-capacity level; and a program code mechanism configured to preset the counted value of said counter to a predetermined third value corresponding to the empty level in response to said third detector detecting that the quantity of the stored coins in the coin storage device has decreased to the empty level.

* * * * *